US011590055B2

(12) United States Patent
Sanchez

(10) Patent No.: US 11,590,055 B2
(45) Date of Patent: Feb. 28, 2023

(54) STORAGE/CONTAINMENT UNIT FOR FLEXIBLE POUCH FILLED WITH BIOPHARMACEUTICAL FLUID, AND METHOD OF ASSEMBLING A FREEZE/THAW CONTAINMENT SYSTEM, USING A PROTECTING BODY

(71) Applicant: SARTORIUS STEDIM NORTH AMERICA, Bohemia, NY (US)

(72) Inventor: Marc Sanchez, Brooklyn, NY (US)

(73) Assignee: SARTORIUS STEDIM NORTH AMERICA, Bohemia, NY (US)

( * ) Notice: Subject to any disclaimer, the term of this patent is extended or adjusted under 35 U.S.C. 154(b) by 224 days.

(21) Appl. No.: 16/943,682

(22) Filed: Jul. 30, 2020

(65) Prior Publication Data

US 2022/0031567 A1 Feb. 3, 2022

(51) Int. Cl.

| | |
|---|---|
| ***A61J 1/16*** | (2006.01) |
| ***A61J 1/14*** | (2023.01) |
| ***A61J 1/10*** | (2006.01) |

(52) U.S. Cl.

CPC . *A61J 1/16* (2013.01); *A61J 1/10* (2013.01); *A61J 1/1468* (2015.05); *A61J 1/1475* (2013.01)

(58) Field of Classification Search

CPC ..... A61B 50/00; A61B 50/30; A61B 50/31; A61J 1/1475; A61J 1/10; A61J 1/1468

USPC ..... 206/438, 370

See application file for complete search history.

(56) References Cited

U.S. PATENT DOCUMENTS

| | | | | |
|---|---|---|---|---|
| 2012/0152943 | A1 | 6/2012 | Leoncavallo et al. | |
| 2015/0374583 | A1 | 12/2015 | Pavlik | |
| 2017/0309357 | A1* | 10/2017 | Gordon | A61B 6/107 |
| 2018/0125757 | A1 | 5/2018 | Sanchez et al. | |
| 2018/0128707 | A1* | 5/2018 | Sanchez | G01M 3/3218 |
| 2019/0030236 | A1* | 1/2019 | Okihara | B65B 55/14 |

FOREIGN PATENT DOCUMENTS

| | | | |
|---|---|---|---|
| EP | 2240012 A2 * | 10/2010 | A01N 1/02 |
| EP | 2 322 442 | 5/2011 | |
| WO | 03/037082 | 5/2003 | |
| WO | 2015/200218 | 12/2015 | |

* cited by examiner

*Primary Examiner* — King M Chu
(74) *Attorney, Agent, or Firm* — Nixon & Vanderhye

(57) ABSTRACT

A protecting device is provided, having two plates forming a rectangular protecting body for sandwiching, constraining and protecting a flexible pouch. The two plates are attached together at a peripheral margin. Each plate has an outer surface with ribs provided in a peripheral annular region of a covering part receiving the pouch, along the peripheral margin. The peripheral margin is mounted in supporting parts of a frame and sliding positioning members may be secured to the peripheral margin, so that the peripheral margin is guided and allowed to be displaced inwardly during filling of the pouch, while the protecting body extends generally planar, at least at panel parts surrounded by the ribs. This allows for progressive conformational change of the protecting body when filling the pouch with biopharmaceutical product, while facilitating reverse displacement of the peripheral margin during draining operations.

21 Claims, 15 Drawing Sheets

STORAGE/CONTAINMENT UNIT FOR FLEXIBLE POUCH FILLED WITH BIOPHARMACEUTICAL FLUID, AND METHOD OF ASSEMBLING A FREEZE/THAW CONTAINMENT SYSTEM, USING A PROTECTING BODY

BACKGROUND OF THE INVENTION

Field of the Invention

The present invention generally relates to the protection of a flexible pouch specially designed to contain a biopharmaceutical fluid and more broadly to a system for containing a biopharmaceutical fluid. The invention also relates to methods for manufacturing/assembling such a system that is adapted for freezing and thawing the biopharmaceutical fluid within the system. A biopharmaceutical fluid means a biotechnological derived fluid, for example a fluid derived from a culture medium, a cell culture, a buffer solution, an artificial nutrition liquid, a blood fraction, a blood derived component or a pharmaceutical fluid or, more broadly, a fluid specifically designed to be used in the medical field. Of course, the fluid may become solid or partly solid after freezing (typically at a temperature much lower than 0° C.).

DESCRIPTION OF RELATED ART

It is known to use a flexible pouch to contain biopharmaceutical fluid. The flexible pouch is able to withstand low mechanical stress without damage. Hence, the leakage risk is reduced. Moreover, the flexible pouch is advantageous since it can be folded or stored flat when there is no biopharmaceutical fluid inside. Hence, the flexible pouch occupies a small volume.

The flexible pouch is generally designed for a single use and to contain a biopharmaceutical fluid volume which is between 1 liter and 500 liters.

However, specifically for shipping of the flexible pouch filled with fluid, for example, between several plant areas or from the provider of the fluid to its client which will use it, but also for storage, the flexible pouch must be protected, although the leakage risk is small.

The document EP-2 322 442 discloses a container for a flexible pouch. The container comprises a lower part and an upper part which are rigid and joined along a common edge and which form a single piece container. The container has a volume which is much more important than the volume of the flexible pouch. Consequently, the container has a useless volume. Moreover, if the flexible pouch is not retained by suitable positioning means provided in the container, it could be moved within the container, especially during shipping. Thus, the leakage risk increases.

Single-use polymeric containers, hereafter called bags or pouches, are successfully used for the storage of biopharmaceuticals in liquid state. Today, bags made of ethylene vinyl acetate (EVA) or low-density polyethylene (LDPE) have been found suitable for the storage and shipping of biological bulks at ambient or cold temperature (2 to 8° C.). However, problems exist in freezing applications with bags as currently configured. At low temperatures, the physical properties of plastic materials may change sufficiently to introduce brittleness that can reduce the capacity of the bag to absorb external forces, i.e., shocks without fracturing. In addition, ice volumetric expansion can cause significant mechanical stress leading to bag, port, tubing, or connector breakage. It is well known that current commercially available unprotected bags do not adequately protect frozen products.

To eliminate problems related to bag breakage, Sartorius Stedim Biotech has developed the Celsius™ FFT concept (FFT for "Flexible Freeze and Thaw"), which combines a flexible pouch with a semi-rigid protective shell. The contribution of the protective shell is predominant in the absorption of stresses resulting from processing or handling conditions.

Document US 2018/125757 provides a protecting body, so that the flexible pouch is sandwiched by the two plates of the protecting body, with a constraining effect. A freeze/thaw protection system may be obtained, by combining a single-use flexible container wrapped by such a protecting body and a protective shell. However, uniform fluid distribution may be difficult because, in a filled state of the flexible container, a significant bulge (big belly) in the middle is formed. In frozen state, ice expansion is thus relatively significant, and more time will be needed to freeze this big mass in the middle of the interior volume of the pouch.

Besides, some radial/transverse folds or waves may be formed at the pouch outer surfaces during filling, which may interfere with appropriate fluid distribution, especially in the four corner regions.

Document WO 2015/200218 discloses a single-use flexible freezer bag, in which a tufting coupling is provided, in order to divide the cavity of the container into a plurality of regions. This is of interest to limit risk of having a significant bulge, so that liquid mass concentration is prevented in a middle part of the flexible container. Such design cannot be widely used, especially because the bag design is more complex, which increases the cost of the single-use container. Besides, this kind of container cannot extend planar in empty state and may be more difficult to be drained, especially if the container is filled with a large volume of fluid.

SUMMARY OF THE INVENTION

The purpose of the present invention is to provide a protecting device for obtaining a robust freeze/thaw containment and protection system efficient for limiting liquid mass concentration in middle area of a flexible pouch (typically a 2D-pouch than inflates in a filled state), while keeping flexibility of design for the flexible pouch.

To this end, embodiments of the present invention provide a protecting device for use in freezing, storing and thawing biopharmaceutical materials contained in a flexible pouch, the protecting device comprising:

a protecting body comprising two plates for protecting the flexible pouch, the protecting body comprising a longitudinal axis and having four sides, the four sides comprising two longitudinal sides extending parallel to the longitudinal axis and two other sides that include a first end side and a second end side each perpendicular to the longitudinal axis, an attachment system for fastening the two plates so that in an assembled state of the two plates, the protecting body comprises a peripheral margin that extends annularly in a protecting body reference plane, the peripheral margin being provided with at least one opening able to receive at least one port of the flexible pouch;

wherein the two plates define two mutually unfixed facing parts forming a covering part for covering the flexible pouch, the covering part being surrounded by the peripheral margin;

wherein in the assembled state:

the protecting body extends planar in an empty state of the flexible pouch, along the protecting body reference plane;

the two plates are configured to sandwich the flexible pouch for constraining the flexible pouch in a filled state of the flexible pouch, the protecting body being deformable due to shrinking of the two plates in at least one direction belonging to the protecting body reference plane; and the two plates respectively form a first outer surface and a second outer surface of the protecting body, facing in opposite directions, at least one amongst the first outer surface and the second outer surface being a surface having a plurality of ribs, which extend at least on a peripheral annular region of the covering part, along the peripheral margin.

With such ribbing, geometry of the protecting device in filled state of the pouch constrained by the plates can be impacted favorably. For large volumes (about 50 liters, 75 liters or more for instance), a full surround rib or similar pattern of ribs parallel to the peripheral margin can prevent undesirable formation of waves that create dead volumes and impair efficient drainage operation.

More generally, the ribs can locally structure a plate, preferably the two plates, near the peripheral margin to prevent undesirable folding/bending of a plate while still allowing the protecting body to expand with filling of the pouch contained therein. The ribs thus may be ribs arranged to locally structure the covering part of the protecting body, for instance around a panel part which may be substantially rectangular or provided with a square shape.

A good compromise may be obtained between ease of the covering part at expanding transversally (vertically when the protecting body reference plane is horizontal), with suitable flexibility of the plates using, while also preventing fold formation neat the peripheral margin. The plates may be accordion-like, using several ribs arranged parallel to the respective four margin portions of the peripheral margin.

Accordion effect in a plate may be obtained by having parallel ribs, each of the parallel ribs locally having a thickness lower than in other portions of the plate. When a pouch filled with fluid constrains the interior faces of the plates (where the ribs define an elongated hollow or groove), the ribs may help for having a greater expansion in direction transverse (perpendicular) to the protecting body reference plane, despite low flexibility of the plate material as compared to plastic material of the pouch.

Each rib of the plate may be obtained by locally drawing the plastic material, thus causing a reduction in thickness at the ribs. This may be sufficiently deep drawing, in order to have the hollow or groove of each rib deeper than average thickness of the plate. Each of the ribs may have a flaring shape, typically forming a U-shape profile in a section view (section transverse to length direction of the rib).

Depth or height of the ribs may be at least twice or at least three times the thickness of the plate (plate material thickness), preferably at least four or height times. With such height and with slight decrease in thickness, the ribs located close to the peripheral margin efficiently improve expansion (with a higher shift relative to the protecting body reference plane) near the margin portions, as if the plate was locally more expandable. Even if the margin portions cannot expand, due to the attachment system, all or part of the peripheral annular region may expand/deviate from the protecting body reference plane quicker than if the plate was deprived from such ribs.

The grooves formed by the ribs are elongated, such grooves having a groove length corresponding either to length extension, or to width extension of the plate, which is a generally rectangular plate. The groove interior width may be superior to 10 mm, preferably superior or equal to 15 mm. In some embodiments, such width is between 20 and 40 mm. As apparent in FIGS. 5A, 5B, a wavy profile may be obtained due to the grooves (between panel part(s) and peripheral margin), before any filing operation.

The region provided with the ribs may be an annular region formed as a transition region between a panel part without ribs and the peripheral margin that is typically not allowed to move transverse to the protecting body reference plane. Such transition region may form a homogenous sloped region in expanded/filled state of the system, as formation of undesirable waves/folds is prevented.

The peripheral margin is configured to remain flat along the protecting body reference plane in the assembled state, independently of a filling state of the flexible pouch covered by the covering part. Optionally, the attachment system may be a fastening assembly, two opposite sides (opposite margin portions) of the peripheral margin being part of the fastening assembly to prevent any shifting in position between the two plates once they are mutually fastened at least in the two margin portions, in a predetermined superimposed configuration for forming the protecting body.

The plates typically are separate pieces, preferably two pieces. The constraining effect is of interest for a step of emptying the flexible pouch, and is advantageous to limit vertical expansion of the fluid, especially during freezing, when the protecting body reference plane extends substantially horizontal.

The vertical expansion may be also limited by having a belt effect exerted in a middle region of the covering part, possibly by retaining the shrink stroke of the peripheral margin, selectively in margin middle portions located on both sides of this middle region.

In some embodiments, ribs of the plurality of ribs are distributed at least in two opposite parts of the surface which are longitudinally opposite parts.

Besides, the ribs of the plurality of ribs include one or more first transverse rib portions proximal or adjacent to the first end side and one or more second transverse rib portions proximal or adjacent to the second end side.

In various embodiments of the device, recourse may optionally also be had to one or more of the following dispositions:

the one or more first transverse rib portions include two first transverse ribs portions, while the one or more second transverse rib portions include two second transverse ribs portions.

the attachment between the plates is a removable attachment, allowing the plates to be fully separated.

the plates are removably fixed to each other by the attachment system distributed (selectively distributed) in the peripheral margin.

two opposite margin portions, provided longitudinally in the peripheral margin, are part of a fastening assembly to prevent any shifting in position between the two plates once they are mutually fastened at least in the two margin portions, in a predetermined superimposed configuration for forming the protecting body.

each of the two plates comprises embossments or boss portions, which define, in assembled state of the plates (to form the protecting body), several protecting body embossments protruding in a first direction perpendicular to the protection body reference plane, forming corresponding cavities opening in a second direction opposite to the first direction.

the embossments may be longitudinally distributed in the peripheral margin.

a number of the embossments provided in one of the two plates are engaged in a same number of the corresponding cavities provided in the other one of the two plates.

the two plates are two pieces.

the two plates may have a same thickness that is lower than 2 mm, each of the two plates having a density superior to 1.10 g/cm$^3$ and being made of plastic material.

the two plates are made of same plastic material, preferably transparent or translucent.

the protecting body is made of a freeze resistant polyester or copolyester material that is not brittle at about 25° F. or −4° C.

the material of the protecting body is PET.

the material of the protecting body is TRITAN (i.e. a copolyester compound called TRITAN™, which is a transparent amorphous thermoplastic material, typically made by combining three monomers; some formulations of this material do not contain additives, while others contain about or less than 10% additives).

the material of the protecting body is an amorphous copolyester made by combining the following monomers: dimethyl terephthalate, 2.2,4,4-tetramethyl-1,3-cyclobutanediol, and 1.4-cyclohexanedimethanol.

the protecting body is directly engaged by positioning members that belong to the attachment device, in order to have a profile of shrink at the protecting body circumference, optionally with almost no reduction or less shrink due to direct engagements of the positioning members engaged in a middle region of the protecting body, at the margin portions.

the positioning members may be sliders or similar members housed in a guiding or covering part of a holding and retaining assembly, which may forms a stationary frame around a hollow space/location for the pouch.

each of the positioning members may have inserting pin or inserting member that is inserted either in a protecting body through-slot or in a hollow part delimited by a pair of respective embossments of the two plates (the slot or hollow part being provided in the peripheral margin, in order to not interfere with expansion of the covering part that covers the pouch).

the ribs of the plurality of ribs further include a group of elongated rib portions, extending in the peripheral annular region of the covering part.

the elongated ribs may be parallel to the longitudinal axis, thus extending perpendicular to any one of the first transverse rib portions and the second transverse rib portions.

the group of elongated rib portions may consist in longitudinal ribs and/or comprise two opposite elongated rib portions/ribs, which are longer than any one of the first transverse rib portions and the second transverse rib portions.

each plate is provided with a clearance area (which is an area without any relief/rib) provided between and/or separating longitudinal rib portions that are distributed in respective halves of the plate.

each plate has one or two pairs of elongated continuous rib portions, parallel to the longitudinal axis, which extend cross a middle section or middle transverse band of the plate.

the elongated continuous rib portions extend longitudinal to remain close, typically only at a distance of less than about 30 or 50 mm from a respective one of the two opposite margin portions of the rectangular peripheral margin, while the transverse distance between the two opposite margin portions is at least equal to 500 or 600 mm, preferably superior or equal to 700 mm, when the plate extends planar (when the plates are assembled to sandwich the pouch, this planar state is obtained for non-filled state of the pouch).

amongst each pair of elongated continuous rib portions, parallel to the longitudinal axis, which extend cross a middle section or middle transverse band of the plate, each elongated continuous ribs extends straight to remain close from a margin portion, at a distance less than 10% of the total plate width from this margin portion.

the plate has longitudinal rib portions of relatively shorter length, as compared to the elongated continuous rib portions, also called side rib portions, which are crossing over the middle section/middle transverse band, the longitudinal rib portions of relatively shorter length not interfering with the clearance area or not interfering with a plate middle area only provided with transverse rib portions.

the corner ribs comprise first corner ribs interconnecting one of elongated rib portions with one of the first transverse rib portions.

the corner ribs further comprise second corner ribs interconnecting one of elongated rib portions with one of the second transverse rib portions.

in the surface provided with the plurality of ribs, a continuous rectangular region without any ribs is surrounded by (and possibly delimited between) a first group of ribs extending annularly in the peripheral annular region of the covering part, and a second group of ribs extending parallel to the first group of ribs and arranged closer to the peripheral margin as compared to the first group.

the first group of ribs may extend annularly at a maximal distance from the peripheral margin, which is a first distance, while the second group of ribs may extend at a minimal distance from the peripheral margin, which is a second distance, the second distance being typically superior to the first distance.

In some embodiments, the protecting body may extend substantially horizontally and/or the first outer surface, which is delimited by the peripheral margin, is a lower surface of the protecting body, while the second outer surface, delimited by the peripheral margin, is an upper surface of the protecting body.

In particular embodiments, each of the lower surface and the upper surface comprises a pattern of ribs distributed in two halves, the first transverse rib portions being provided in a first half of the two halves, while the second transverse rib portions are provided in a second half of the two halves.

Optionally, the pattern of ribs in the lower surface and the pattern of ribs in the upper surface are symmetric relative to the protecting body reference plane, the two halves being preferably two symmetrical halves relative to a median plane that is perpendicular to the protecting body reference plane.

In some embodiments, the pattern of ribs is surrounding at least one smooth panel region extending away from the peripheral margin.

Around the panel, one or two continuous or discontinuous ribs of the pattern of ribs are configured to allow fluid (liquid) to be spread to the edges and corners. In embodiments, the ribbing pattern provides more flexibility to the protecting body edge regions to be deformed (regions adjacent to the four respective side edges) by forming sloped portions, parallel to the peripheral margin. Such rib delimiting the panel may be a continuous or discontinuous annular rib.

The longitudinal ribs, elongated, may propagate the hinge effect at junction (which may be a rectilinear junction)

between the peripheral margin where the plates remain fixed in a plane and one long side amongst the four sides of the rectangular covering part.

The transverse ribs, typically also elongated, may propagate the deployment with hinge effect at junction (which may be a rectilinear junction) between the peripheral margin where the plates remain fixed in a plane and one short side amongst the four sides of the rectangular covering part.

In various embodiments of the device, recourse may optionally also be had to one or more of the following dispositions:

the protecting body is provided with ribs in the first outer surface and in the second outer surface, so that a first plurality of ribs is formed on the first outer surface and a second plurality of ribs is formed on the second outer surface.

the protecting body is configured to expand along a direction perpendicular to the body reference plane due to filling of the flexible pouch sandwiched between the two plates, so that the two mutually unfixed facing parts form respective panels, which are each: extending parallel to the protecting body reference plane, and surrounded by reliefs elongated to extend parallel to the peripheral margin.

the reliefs may be protruding outwardly and formed by a part of the ribs included in each of the two plates comprises at least one plate panel part extending between the first transverse rib portions and the second transverse rib portions.

a single panel may be formed by each plate outer surface provided with ribs.

two panel portions, longitudinally distributed, may be formed by each plate outer surface provided with ribs.

each the two plates has at least one central portion arranged away from the two end sides.

one or two ribs may extend transversally to separate two panel parts in a same plate, such ribs typically extending transverse in such central portion.

each panel part is formed without any ribs or hinge lines.

in non-filled state of the pouch or in any flat state of the of the protecting device, each surface amongst the first and second outer surfaces is provided with height differences of 0.8 to 20 mm (and not protruding more), the maximum height reliefs are provided on areas surrounding the one or two panel parts, while no height difference is found in the panel part(s).

In some embodiments, the protecting device may be provided with a holding and retaining assembly, separate from the attachment system, for supporting the protecting body at the peripheral margin, away from any one of the ribs of the protecting body. Typically, the holding and retaining assembly may comprise a frame with abutment surfaces arranged between the covering part and the peripheral margin, in order to allow the two plates moving, extending, and shrinking in a transverse direction belonging to the protecting body reference plane, without having the peripheral margin displaced inwardly beyond the abutment surfaces.

In various embodiments of the protecting device, recourse may optionally also be had to one or more of the following dispositions:

the peripheral margin is provided with positioning members spaced from any one of the ribs of the protecting body.

the positioning members are configured to limit movement in the transverse direction of at least one part of the peripheral margin, in order to limit expansion of the flexible pouch in at least one region that is intermediate between the first transverse rib portions and the second transverse rib portions.

the first transverse rib portions are typically proximal to the first end side and distal from the second end side, while the second transverse rib portions are proximal to the second end side and proximal form the second end side (preferably, the first transverse rib portions are not spaced from the corresponding first end side by a distance more than 15 or 25% of the total length of the plate, as measured along the longitudinal axis in the planar empty state; similarly, the second transverse rib portions may be not spaced from the corresponding second end side by a distance of more than 15 or 25% of the total length of the plate, as measured along the longitudinal axis in the planar empty state).

each of the first transverse rib portions and the second transverse rib portions extends perpendicular to the longitudinal axis and belong to an intermediate region between two corner regions respectively adjacent to an intersection of two of the four sides.

the two corner regions are formed to be elastically more deformable than the intermediate region provided with the first transverse rib portions and the intermediate region provided with the second transverse rib portions.

each intermediate region is adjacent to one amongst the first end side and the second end side.

each amongst the first outer surface and the second outer surface comprises longitudinal rib portions that extend parallel to the longitudinal axis in two opposite side regions, in order to be each proximal to the peripheral margin and distal to the longitudinal axis.

each of the corner regions are formed to be elastically more deformable than any one of the side regions provided with the longitudinal rib portions.

In some embodiments, each plate may be provided with several ribs protruding outwardly (i.e. protruding upwardly for the top plate, downwardly for the lower plate). The ribs which are closer to the peripheral margin (so-called side ribs) may be protruding more than any other rib present in the plate.

The maximum in height (protruding height) is obtained at the side ribs, while a minimum in rib height may optionally be obtained in the corner regions.

Each of the lower surface and the upper surface has a planar surface, while height of the rib portions or similar protruding portions protruding from the planar surface is large (for instance greater than 6 or 10 mm) only in regions away from two virtual diagonal lines provided in each plate that is rectangular in shape.

In some embodiments, the protecting body may be have:

the two plates made as two separate pieces, having same circumferential size and same outer shape, each of the first outer surface and the second outer surface comprising first transverse rib portions proximal to the first end side and second transverse rib portions proximal to the second end side.

the two plates may be two separate identical pieces.

the plurality of ribs and the protecting body are made of same freeze resistant polyester or copolyester material, the two plates being two separate pieces.

the plate material is not brittle at about 25° F. or −4° C., the material being preferably PET or TRITAN.

the two plates a made of deformable plastic more rigid than the flexible pouch and configured so that an interspace between the two plates, as measured perpendicularly to the protecting body reference plane in a filled state of the flexible pouch, increases with increasing distance from the peripheral margin.

the protecting body is expansible with corner regions less strengthened by the ribs.

each rib of the plurality of ribs delimits an interior hollow opening inwardly, in order to open toward the flexible pouch.

each rib of the plurality of ribs delimits an interior hollow separate from the peripheral margin so that the interior hollow provides additional volume in an interspace between the two plates.

each of two plates is a plate having a rectangular shape with four corners and two virtual diagonal lines each intersecting a pair of corner vertices of the four corners, and wherein each of the two virtual diagonal lines intersects: a first series of corner ribs proximal to the first end side and protruding outwardly along a direction perpendicular to the protecting body reference plane, and a second series of corner ribs proximal to the second end side and protruding outwardly along a direction perpendicular to the protecting body reference plane.

each of the corner ribs are curved and are connecting two rib portions that are perpendicular one to each other.

the first transverse rib portions may be directly connected to the corner ribs of the first series, while the second transverse rib portions may be directly connected to the corner ribs of the second series.

Embodiments of the invention also provide a freeze/thaw containment system for containing a biopharmaceutical composition, comprising:

the protecting device according to the invention, a flexible pouch sandwiched between the two plates, the flexible pouch being fillable with a biopharmaceutical composition via at least one port of the flexible pouch which protrudes outwardly through the least one opening, the flexible pouch being more flexible than material of the protecting body.

In some embodiments, the two plates constrain the flexible pouch by a covering part that extends between two margin portions of the peripheral margin.

The system may be provided with a frame for attachment of the protecting device selectively at the peripheral margin. Accordingly, the frame allows having the covering part of the protecting body suspended, as only the peripheral margin is fixed to and retained by the frame. In some options, the frame is rectangular and does not cover the covering part. In other portions, all or part of the frame may be included in a protective shell provided with shell parts forming a housing for accommodating the covering part. Such protective shell preferably includes all or part of the attachment system, thus allowing the peripheral margin to be maintained in the protecting body reference plane that typically coincides with an interspace provided by the frame.

The frame may be provided with upper parts and lower parts in some embodiments, such parts being assembled to form the frame with the retaining feature relative to the peripheral margin. Positioning members may be either provided on the peripheral margin, or be included in the parts of the frame.

The freeze/thaw containment system (which is a protection system for storing and withstanding freezing and thawing of the biopharmaceutical composition contained in the flexible pouch) may be assembled using a method that comprises:

sandwiching a flexible pouch between two plates of a protecting body, selectively by a covering part distributed in the two plates for covering the flexible pouch, the protecting body being configured for protecting the flexible pouch and comprising the two plates, the protecting body further having a longitudinal axis and comprising four sides, the four sides comprising two longitudinal sides extending parallel to the longitudinal axis and two other sides that include a first end side and a second end side each perpendicular to the longitudinal axis, fastening the two plates by an attachment device at a peripheral margin so that in an assembled state of the two plates, the protecting body has the peripheral margin which extends annularly in a protecting body reference plane, around the covering part, inserting through the peripheral margin, in at least one opening, thereof, at least one port of the flexible pouch (which is thus received in such at least one opening);

maintaining the peripheral margin parallel to the protecting body reference plane, by a holding and retaining assembly accommodating the peripheral margin in an annular housing, so that the peripheral margin remains flat along the protecting body reference plane in the assembled state, independently of a filling state of the flexible pouch covered by the covering part;

wherein in the assembled state:

the two plates are configured to sandwich the flexible pouch for constraining the flexible pouch in a filled state of the flexible pouch; and the two plates respectively form a first outer surface and an upper surface of the protecting body, at least one amongst these surfaces being a surface having a plurality of ribs which extend at least on a peripheral annular region of the covering part, along the peripheral margin, in order to locally structure the covering part of the protecting body.

The assembling may be easy and the ribs are provided to protrude outside, with these ribs distributed in two opposite parts of the surface which are longitudinally opposite parts.

The protecting body may be less ribbed or provided with low height reliefs in four corner regions of the protecting body, each corner region being respectively adjacent to an intersection of two of the four sides.

The flexible pouch is inflated when filling the flexible pouch with the biopharmaceutical composition in a fluid state, and the covering part is constraining the flexible pouch, while guided when expanded due to side ribs that prevent undesirable centripetal folds near the peripheral margin.

Other features and advantages of the invention will become apparent to those skilled in the art during the description which will follow, given by way of a non-limiting example, with reference to the appended drawings.

DETAILED DESCRIPTION OF EMBODIMENTS

In the various figures, the same references are used to designate identical or similar elements.

In the different Figures, a vertical direction, a longitudinal direction and a lateral direction are based on the freeze/thaw containment system horizontally stored in a shelf. A direction perpendicular to the longitudinal direction is the lateral direction. One direction according to the height of the freeze/thaw containment system 1 is the vertical direction, reflected by direction Z in the FIGS. 4 and 6-8 in particular.

Figure 3:
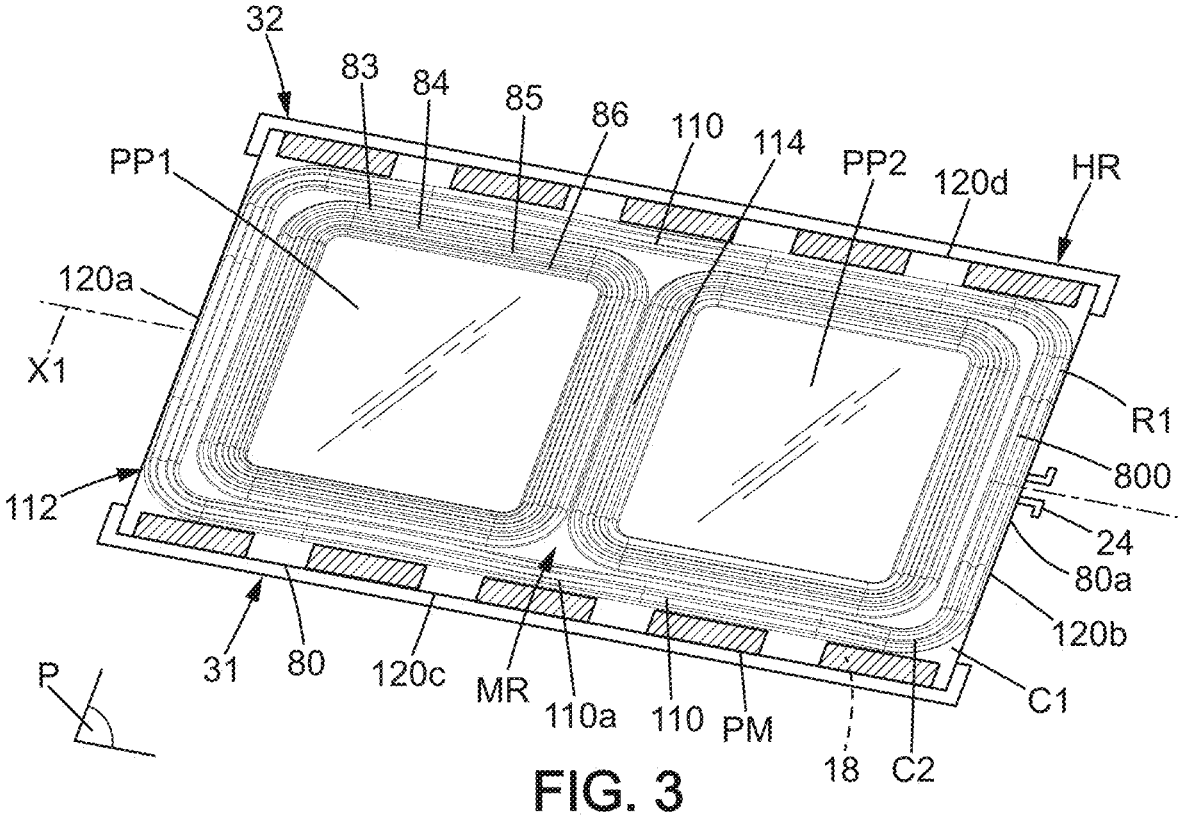
FIG. 3 illustrates a freeze/thaw containment system, in which a flexible pouch is sandwiched between the two plates forming the protecting body, in an empty state of the pouch, while a peripheral margin of the protecting body is sandwiched between positioning members.
Figure 4:
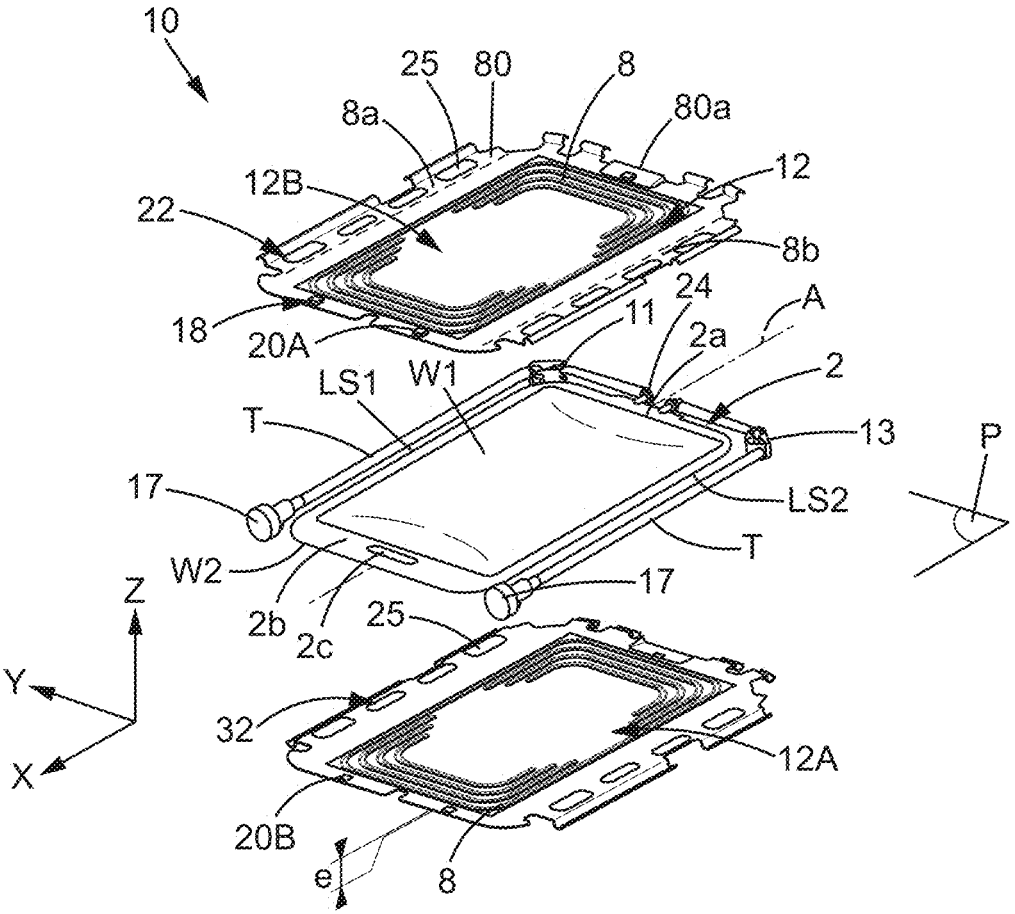
FIG. 4 is a perspective view of a system for containing a biopharmaceutical fluid according to an embodiment of the invention, in a configuration with the protecting body disassembled.
Figure 6:
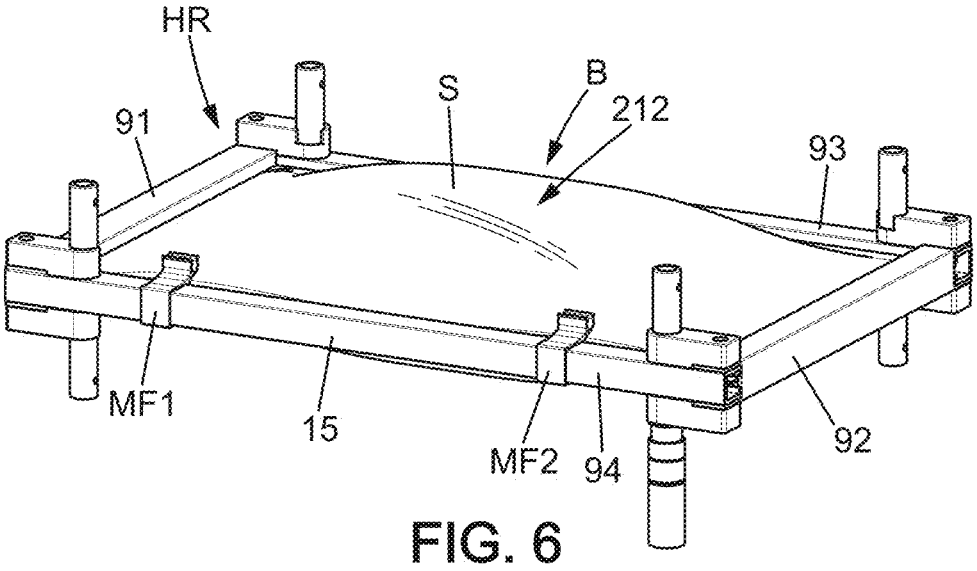
FIG. 6 is a perspective view showing a complete freeze/thaw system, using a peripheral frame that houses internal positioning members, in a filled configuration in which the positioning members are not active to limit inwardly movement and shrinking of the plates that sandwich the flexible pouch.
Figure 7:
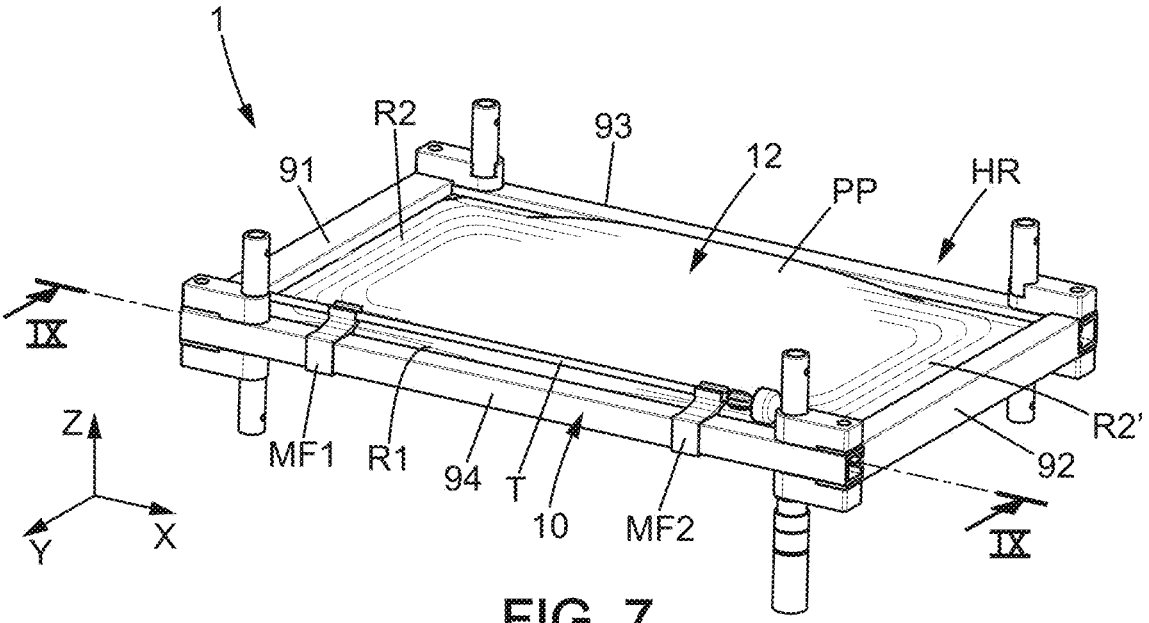
FIG. 7 is a perspective view similar to FIG. 6 but with some of the internal positioning members adjusted to selectively limit plate displacement and shrinking in a middle region of the protecting body, the plates being provided with a first ribbing pattern facilitating fluid displacement toward the corners.
Figure 8:
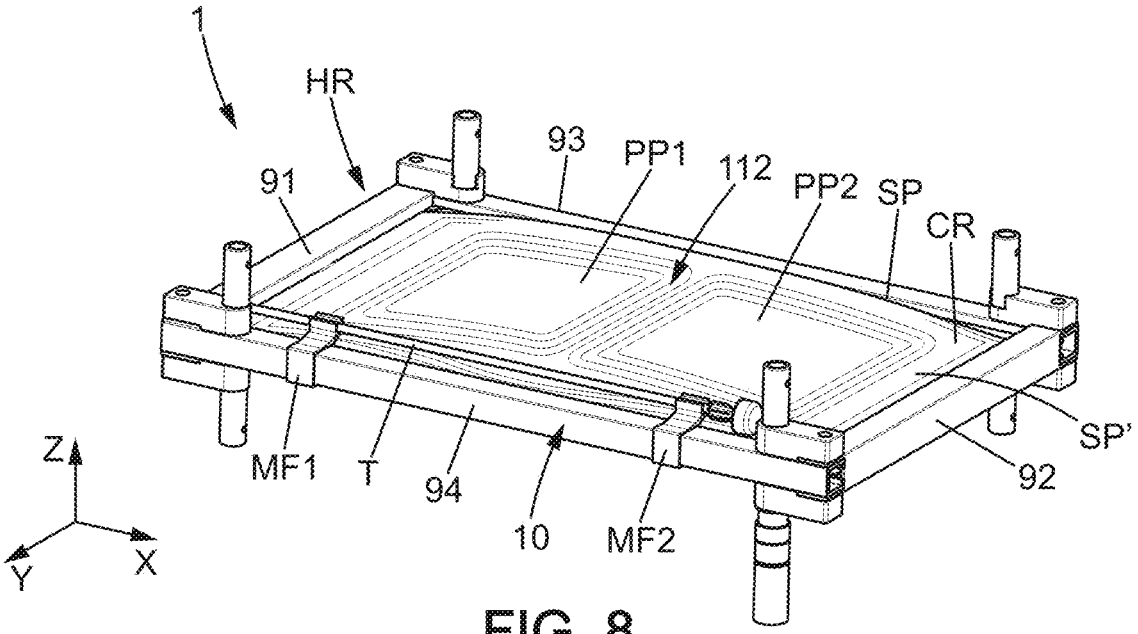
FIG. 8 is a perspective view similar to FIG. 7, also with some of the internal positioning members adjusted to selectively limit plate displacement and shrinking in a middle region of the protecting body but with a second ribbing pattern facilitating fluid displacement toward the corners.

In embodiments, the freeze/thaw containment system 1 may be such as illustrated in FIGS. 3, 4 or in FIG. 6, 7 or 8, in order to include a protecting body (12, 112, 212) that covers both faces of a flexible pouch 2 for biopharmaceutical materials, hereafter called biopharmaceutical composition Q.

Thus, when the biopharmaceutical composition Q is frozen, the containing region or useful part of the flexible pouch 2, i.e. inner region relative to the peripheral seal J, may be slightly curved. Hence, a dimension on the longitudinal direction (along longitudinal axis X1) of the protecting body 12 slightly decreases. In this case, the biopharmaceutical composition is slightly constrained by the two plates 12A, 12B.

In accordance with embodiments, the plate dimension reduction (as considered in XY plane) is obtained with a profile of shrink strokes, such reduction being adjusted to be different, depending on longitudinal positions of some positioning members PM integral with margin portions of the protecting body that locally prevent or limit such dimension decrease, for a control of the shrink stroke, as it will be described below. Additionally or in variants, a ribbing is provided for controlling that the shrinkage is obtained without decreasing height on pouch sides or altering an optimal shape of the pouch 2.

Figure 1:
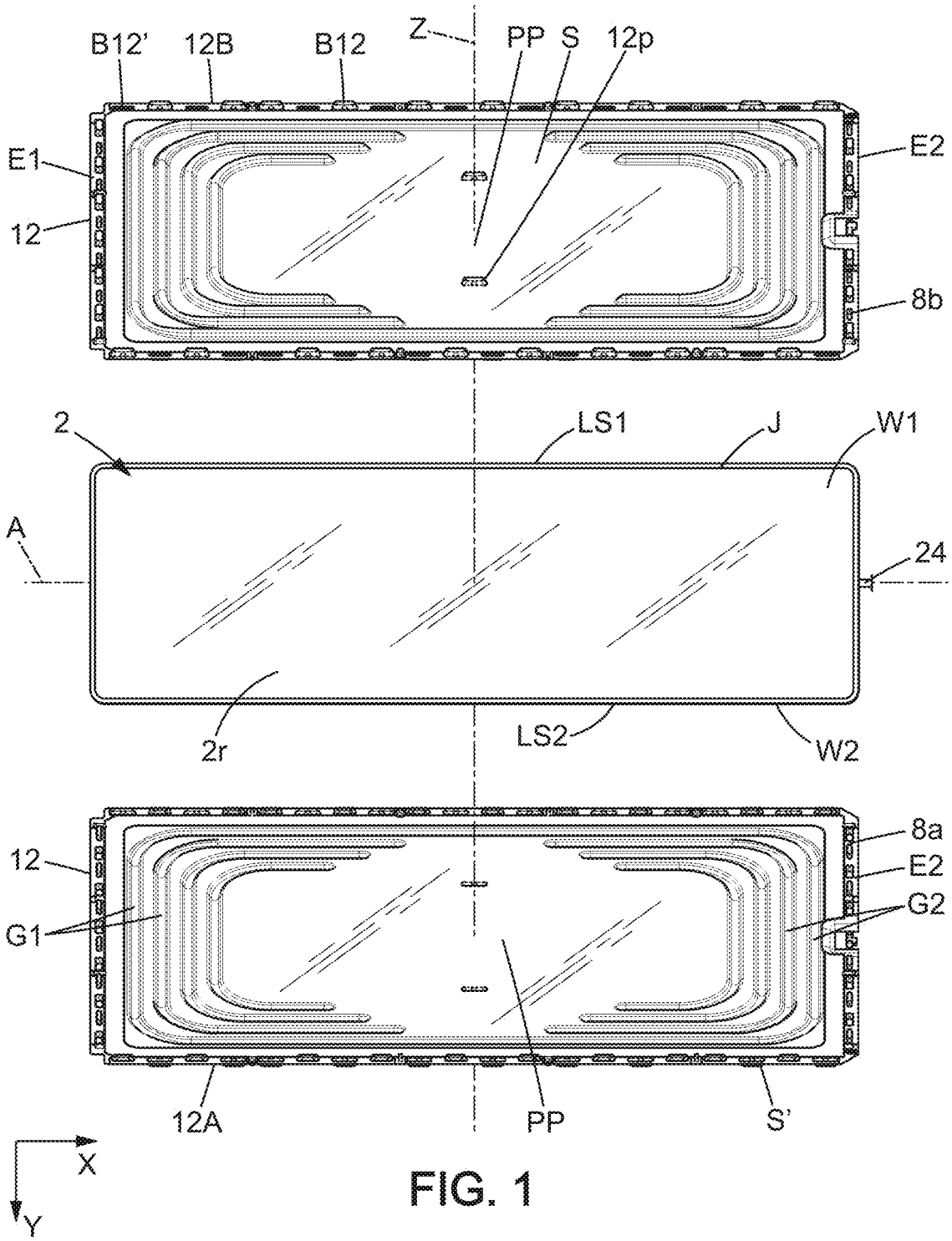
FIG. 1 is a perspective view of a protecting device in accordance with a first embodiment of the invention, before assembling the two plates of the protecting body.

Referring to FIGS. 1, 3 and 4, the protecting body 12 or 112 comprises two plates 12A, 12B for protecting the flexible pouch 2. The two plates 12A and 12B may be made separate. The protecting body 12, 112 here comprises ribs R1, R2, R2', R3, R4 typically on each plate 12A, 12B. The two plates 12A, 12B may be two pieces, which define the protecting body 12, 112, preferably without any additional piece. More generally, only two pieces may form the covering part 8 receiving the pouch 2.

The protecting body 12, 112, 212 is obtained by fastening the two plates 12A, 12B in a circumferential part that surrounds a covering part 8 of the protecting body 12. For instance, the protecting body 12, 112, 212 is assembled when sandwiching the empty pouch 2 by the covering part 8, by securing the circumferential parts of the plates 12A and 12B together. For this, an attachment device or attachment system 18 is provided, in order to fasten the two plates 12A, 12B. In an assembled state of the two plates 12A, 12B, the protecting body 12, 112, 212 comprises a peripheral margin 80. The peripheral margin 80 is obtained by securing respective margin portions 8*a*, 8*b* of the plates. Each margin portion 8*a*, 8*b* may be composed of four outer band regions of the plates 12A and 12B.

The protecting body 12, 112, 212 extends planar, along a protecting body reference plane P, and cannot inflate like a thin rubber balloon, as the plates 12A, 12B are relatively rigid to constrain the pouch 2. The protecting body 12, 112, 212 may be typically as rigid as or more rigid than a PET bottle for containing sparkling water, thus allowing very limited deformation as compared to the material of the flexible pouch 2. In the plates 12A, 12B, ribs R1, R2, R2',800 also structure the covering part 8 in a peripheral annular region 8*p* thereof, typically along the peripheral margin 80 to have a guiding effect when the protecting body 12 expands. The structuring is not impairing the expansion as only linear regions for local/linear strengthening are provided, so that plate deviation angle α as illustrated in FIG. 10B may be sufficiently high. For instance, such angle α is greater than 25 or 30° relative to the reference plane P, in full filled state of the pouch 2 sandwiched by the plates 12A, 12B.

Figure 2A:
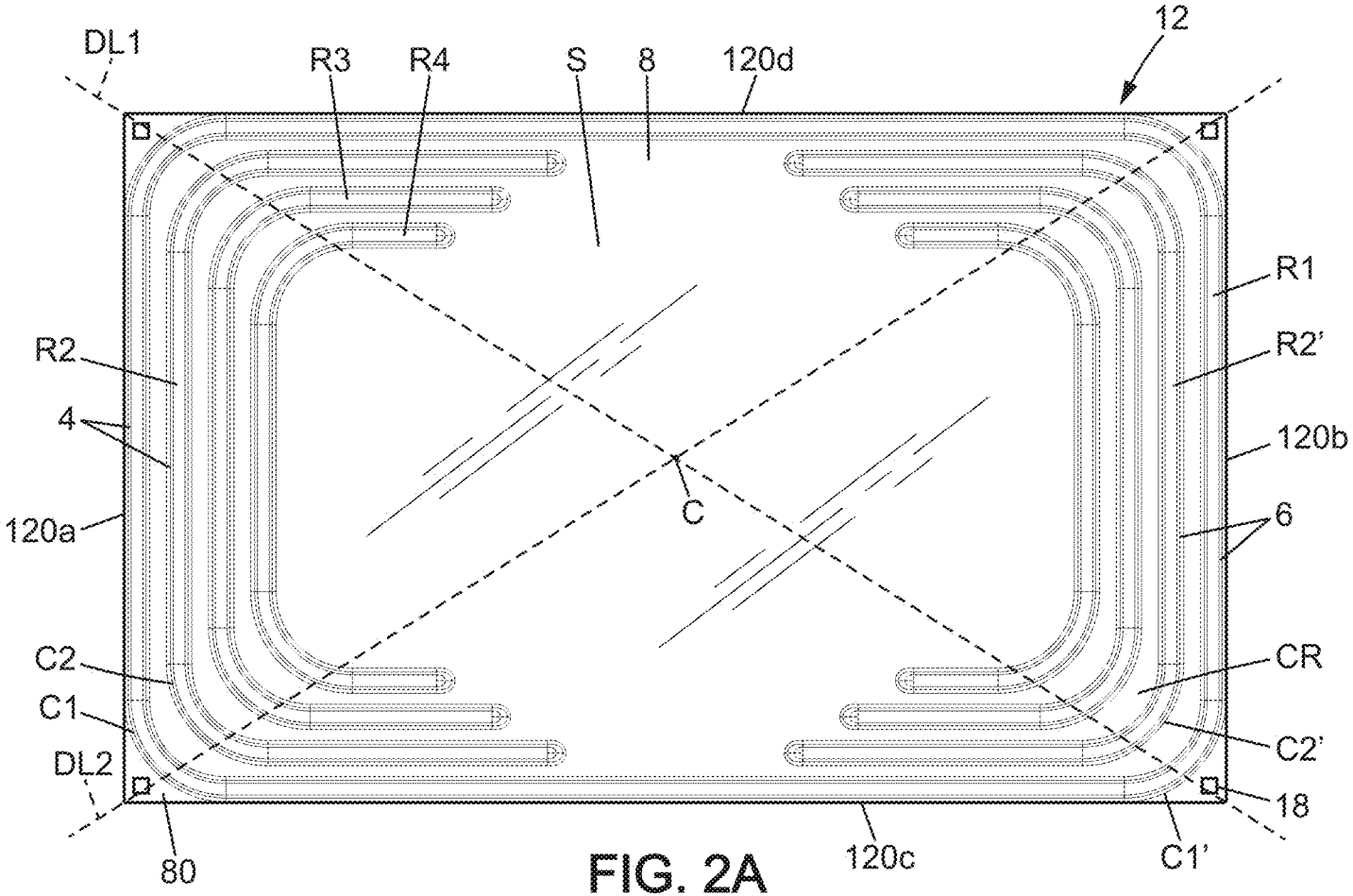
FIG. 2A is a top view showing the protecting device of FIG. 1 assembled, with a ribbing pattern provided on a protecting body outer surface (here a top surface), including rib portions of lower height in corners.
Figure 2B:
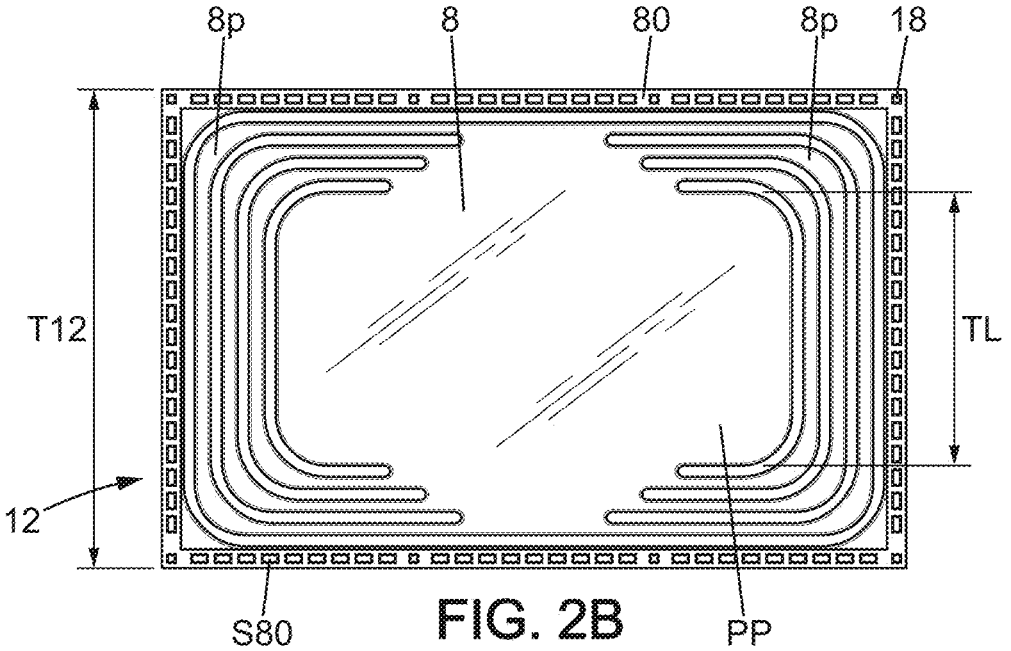
FIG. 2B shows a part of the protecting device of FIG. 1, which is horizontal cut along a plane parallel to the protecting body reference plane, here with the cut made above corner rib portions and below other rib portions, in order to illustrate that all the ribs formed in a plate outer surface define a corresponding interior recess or groove opening inwardly.

In the illustrated embodiment of FIGS. 1, 2A-2B, the ribs R1 and the ribs R2, R2' may be spaced and arranged parallel in the ribbing pattern of the plate 12A or 12B, in order to delimit a continuous rectangular region between them, without any ribs. The ribs R1, which are closer to the peripheral margin 80 as compared to the ribs R2, R2', may form a continuously rectangular ribbing, possibly with rounded corner ribs (curved ribs portions). The ribs R1 thus may be included in a continuous rectangular rib, which is decomposed in two opposite transverse rib portions 4, 6 and two elongated longitudinal rib portions 110, possibly with four corner ribs interconnecting each transverse rib portion to the two longitudinal rib portions 110.

Ribs R3 and/or R4 may optionally be added, with a shift toward a middle region, as compared to the side ribs R1 or the ribs R, R2'. Accordingly, at least three transverse rib portions extending perpendicular to the longitudinal axis X1 of the protecting body 12 may be provided, at each opposite ends of the plate 12A and/or 12B.

Here in FIGS. 1, 2A-2B, 4 and 7, it can be seen that transverse ribs portions 4, 6 are included in U-shaped ribs R2, R2', R3, R4, with the "U" open toward a central region for the corresponding outer surface S or S'. The shape and location of these ribs R2, R2', R3, R4 is suitable to obtain a guiding or "pushing" effect for having more liquid composition Q near the peripheral margin 80.

When a belt effect is obtained as described below (referring to FIG. 13A-13B), a locally lower height may optionally be provided in the middle 110*a* of each longitudinal rib portion 110, as illustrated for instance in FIGS. 3 and 5C.

The system 1 is suitable for containing, freezing/thawing a biopharmaceutical composition Q (see FIG. 10B). Referring to FIGS. 4, 6 and 10A-10B, such system 1 is here horizontal, using a horizontal frame. However, this system may also be vertical in variants, so that the pouch 2 can be stored vertically in a cavity of a vertical frame-like holder (see for instance pouches described in WO 03037082, received vertically by use of rigid slotted frames). Use of a rectangular frame 15, provided with slots or cavities CP opening inwardly, may be of interest, in order to form a compact holder, able to accommodate respective margin portions of the protecting device 10. A storage unit, forming a whole system 1, is obtained when having the pouch 2 and the protecting device 10 together, allowing efficient protection of the biopharmaceutical composition Q.

The flexible pouch 2 is typically a 2D-type pouch, delimited by two longitudinal sides LS1, LS2 and having a substantially rectangular shape without predefined folds on its two main outer faces, as illustrated in FIG. 1 or 4 (empty pouch). Accordingly, the pouch 2 extends substantially planar in non-filled state. The pouch 2 may have two main walls W1, W2. These walls W1, W2 may be directly welded one to each other at a weld or peripheral seal J to delimit an interior volume for containing the biopharmaceutical fluid Q. More generally, the flexible pouch 2 may be of any suitable material for containing a biopharmaceutical composition Q and forms a freezer bag, which may be of large capacity, typically superior or equal to 5 L. More generally, the flexible pouch 2 is of a first capacity and the pouch 2 can expand to have an increase in thickness at least in a middle region away from the four pouch corners, such thickness increasing with the level of filling the pouch 2.

Referring to FIG. 1, the flexible pouch 2 extends in a main plane XY which is, here, the horizontal plane. The pouch 2 has a longitudinal axis A parallel to its long sides, which are here the two longitudinal sides LS1, LS2 in the non-limiting illustrated embodiment. The flexible pouch 2 is sandwiched by the plates 12A, 12B and cannot be removed without detaching at least one of the two plates 12A, 12B, here by disconnecting the plate margin portion 8*a* from the plate margin portion 8*b* (the plates are secured between them, without specific fixation between the pouch 2 and any one of the plates). A holding and retaining assembly HR may be provided, additionally to the attachment system 18, for holding the unit composed of the protecting body 12 and the attachment system 18. The assembly HR is here provided with the frame 15 that includes slides SL or similar slotted structures for holding the protecting device 10 at its peripheral margin 80.

Typically, the receiving part 2*r* of the containing pouch 2 for receiving the biopharmaceutical composition Q cannot be in contact with the rigid structures of the holding and retaining assembly HR, thanks to the protecting body 12, 112 or 212. In the assembled state, the protecting body 12, 112, 212 may entirely cover the receiving part 2*r* of the pouch 2, while the peripheral margin 80 remains planar (here always coinciding with the reference plane P, due to the attachment system 18).

The protecting device 10 provides efficient protection in freezing, storing and thawing operations, while the biopharmaceutical composition Q is contained in the receiving part 2*r* of the flexible pouch 2. The covering portion 8 of the protecting body 12 is not as flexible as the receiving part 2*r* of the flexible pouch 2, due to a difference in material (more rigid for the two pieces forming the plates 12A, 12B).

When placed horizontally and maintained by the holding and retaining assembly HR, the two plates 12A, 12B respectively form a lower surface and an upper surface of the protecting body 12, 112, 212.

Each pouch 2 may be filled with a solution, fluid composition, to be frozen and held with slight compression between the two plates 12A, 12B that serve as heat-exchange surfaces. For this purpose, the plates completely cover the pouch 2, at least in the fluid receiving part, i.e. region defining the interior volume of the pouch 2 (i.e. typically all the walls W1, W2 with possible exception of the annular seal J and optional outer extension(s)). In the illustrated embodiments, the pouch 2 is entirely covered by a protecting body 12, 112 which is formed by the two plates 12A, 12B. During freeze/thaw operations, the plates 12A, 12B are cooled/heated by circulating heat transfer fluid, for instance from an external, programmable refrigeration unit. The slight compression (containment effect) provides improved contact and heat transfer, resulting in a frozen pouch having the general shape of a pillow (see FIG. 6, 7 or 8).

Arrangement for Maintaining and Guiding the Protecting Body

The pouch 2, sandwiched between the plates 12A, 12B may be supported by a structure surrounding the pouch. Such structure may include a frame 15 or similar holding and retaining device HR, arranged peripherally around the covering part 8, so as not to damage the material inside during handling and transport. Referring to FIGS. 6-8, the frame 15 may be a rigid part of a supporting structure. Here, the frame 15 may be a modular part of a device or shelf that may be located in a freezing apparatus. Rollers (not shown) may be provided for facilitating transportation. The frame 15 is typically a rectangular protective frame, leaving the outer surfaces S, S' of the protecting body 12 exposed but forming four protecting sides of the protecting device 10.

Figure 9:
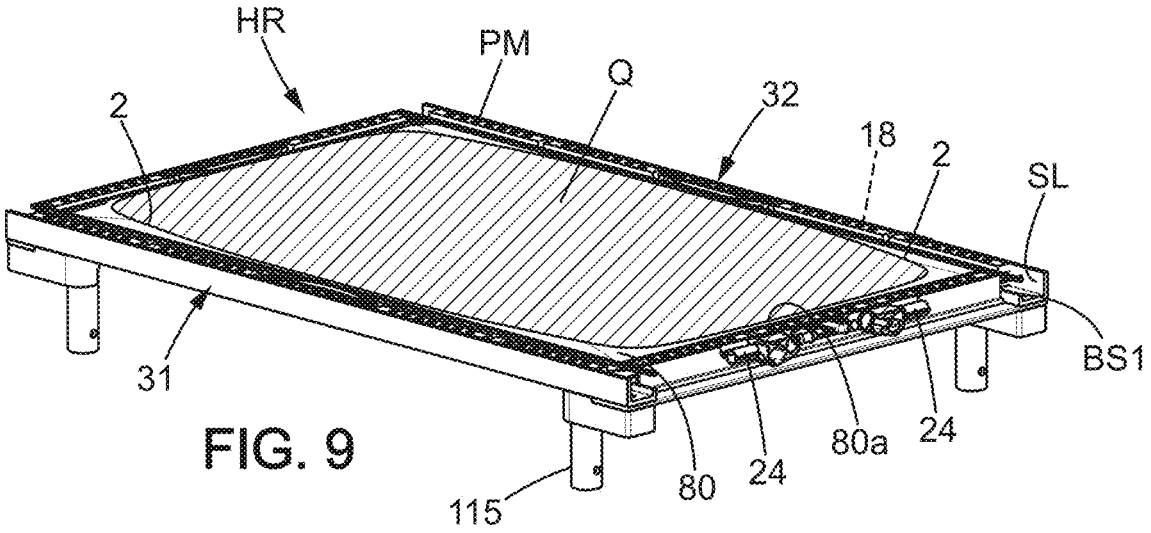
FIG. 9 illustrates an exemplary distribution of positioning members around the protecting body, when using a frame as the one shown in FIGS. 6-7.
Figure 10A:
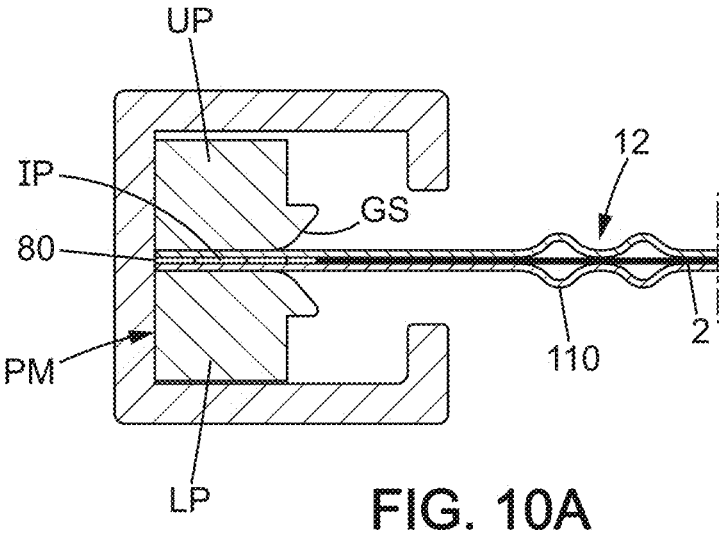
FIG. 10A is vertical cut view showing a positioning member suitable to form a stopper, configured to slide inwardly in a profile cavity while retaining a portion of the peripheral margin of the protecting body.
Figure 10B:
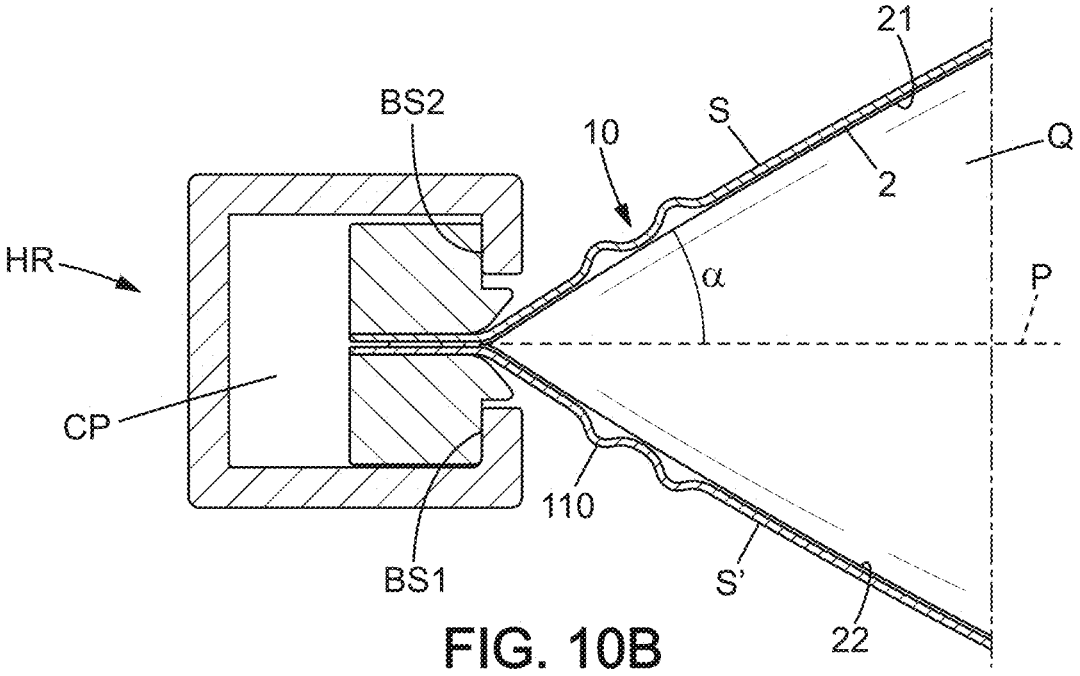
FIG. 10B is same vertical cut view as in FIG. 10A, showing an abutment position so that the positioning member stops inward movement of the corresponding peripheral margin portion of the protecting body.

The frame 15 may be included in a holding and retaining assembly HR, which also includes positioning members PM engaged in the peripheral margin 80 of the protecting body 12, as illustrated in FIGS. 9 and 10A-10B in particular. The assembly may comprise a plurality of feet 115, possibly of tubular shape and suitable for stacking. FIG. 11C illustrates a non-limiting example of integration of feet 115, suitable for obtaining a shelf structure.

More generally, the protecting body 12 and the holding and retaining assembly HR may be assembled in such a way that outer surfaces S, S' (here corresponding to the lower surface S' of the lower plate 12A and the upper surface S of the upper plate 12B) remain exposed (uncovered), while the flexible pouch 2 is placed inside the storage assembly, the pouch 2 being covered by the two plates 12A, 12B. A shown in particular in FIG. 3, the protecting body 12 has a peripheral portion 80 which is engaged in interspaces of the holding and retaining assembly HR. The protecting device 10 is suitable for use in freezing, storing and thawing biopharmaceutical fluid contained in a flexible pouch 2, the fluid being typically introduced after obtaining the whole system 1 for constraining and holding the flexible pouch 2, which is typically a disposable pouch.

The freeze/thaw containment system 1 is provided with several positioning members PM that are secured to or formed on this peripheral margin 80. This peripheral margin 80 may be seen as the part of the protecting body which is complementary to a covering part 8 where the pouch conformation changes, depending on the level of filling of the pouch 2. The system 1 also comprises a frame 15 that is constructed to surround a hollow space where the pouch 2 extends. The frame 15 may be provided with two longitudinal supporting parts that are separate from the positioning members PM.

It is understood that interface Frame—Protecting body is shifted relative to the covering part 8, thus not interfering with the expansion along Z-direction. Besides, ribs of plates 12A, 12B can be formed away from the arrangement provided for maintaining the protecting body 12, 112, since only the peripheral margin 80 is include or in contact with the positioning members PM.

Referring to FIGS. 9 to 12, the positioning members PM may be parts of the attachment system 18 and/or may participate to sandwich the two plates 12A, 12B of the protecting body, at the peripheral margin 80. The positioning members PM may be composed of at least two pieces, which are distinct and separate from the pouch 2 and from the plates 12A, 12B. Here, they comprise a pair of flat bars, possibly pinching the plates 12A, 12B when using an insert piece IP such as a screwing element for assembling the flat bars and form the positioning member PM. More generally, the positioning members PM may be rigid parts, typically made of plastic material (for instance HDPE), provided with fastening pieces or integrated fastening means.

The positioning members PM are configured to protrude each from at least one amongst a lower surface S' and an upper surface S of the protecting body 12, 112, 212, in the peripheral margin 80. Typically, the positioning members PM comprise each a lower part LP and an upper part UP that are two separate flat bars or any suitable pair of pieces configured to sandwich the protecting body, in a region of the peripheral margin 80, outside the hollow space of the frame 15 where the pouch 2 extends.

Referring to FIG. 10A, each front protruding portion of these parts UP, LP has a slanted surface reaching the pressing face in contact with the protecting body 2, in order to form a V-like section groove GS (distributed on both sides of the body peripheral margin 80) that opens inwardly. This groove GS may guide the expansion of the protecting body near the peripheral margin 80, in order to prevent direct contact of the surfaces S, S' against the frame 15 (thus preventing any contact against any profile edge/surface). This of interest for protecting the protecting body material, as the profiles 91, 92, 93, 94 are typically in more rigid material, for instance steel, metal, aluminum or rigid plastic.

In the system shown in FIGS. 9 and 10A-10B, it is understood that a protecting device 10 can be obtained with the protecting body 12, 112, 212 unable to be detached from the frame 15, once this frame is assembled, here with a U-shape or rectangular shape surrounding the pouch 2 contained in the protecting body. Indeed, the positioning members PM that have been provided in or already fixed to the peripheral margin 80, may be housed/retained in the respective parts or profiles 91, 92, 93, 94 of the frame 15. Here, the fastening is adapted to allow the protecting body to move, extend, and shrink along the protecting body reference plane P, i.e. providing a degree of freedom along at least one amongst the directions of axes X and Y shown in FIGS. 1, 4 and 6-8.

Figure 11A:
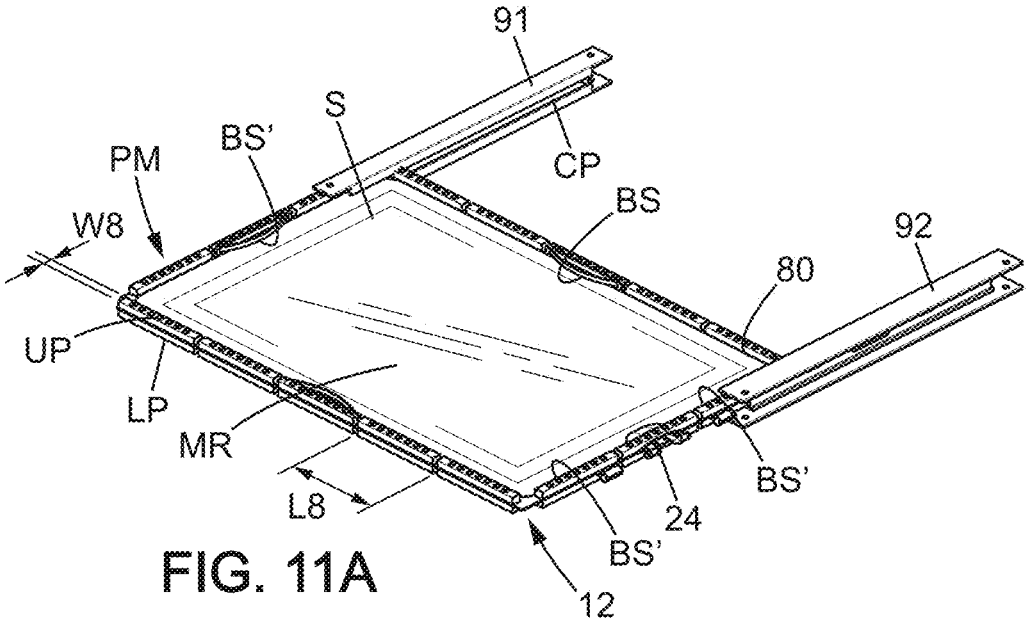
FIGS. 11A, 11B, 11C show respective steps performed when forming a frame for handling and storing a protecting device including the positioning members, with an optional step of fastening feet to define a stackable shelf module.
Figure 11B:
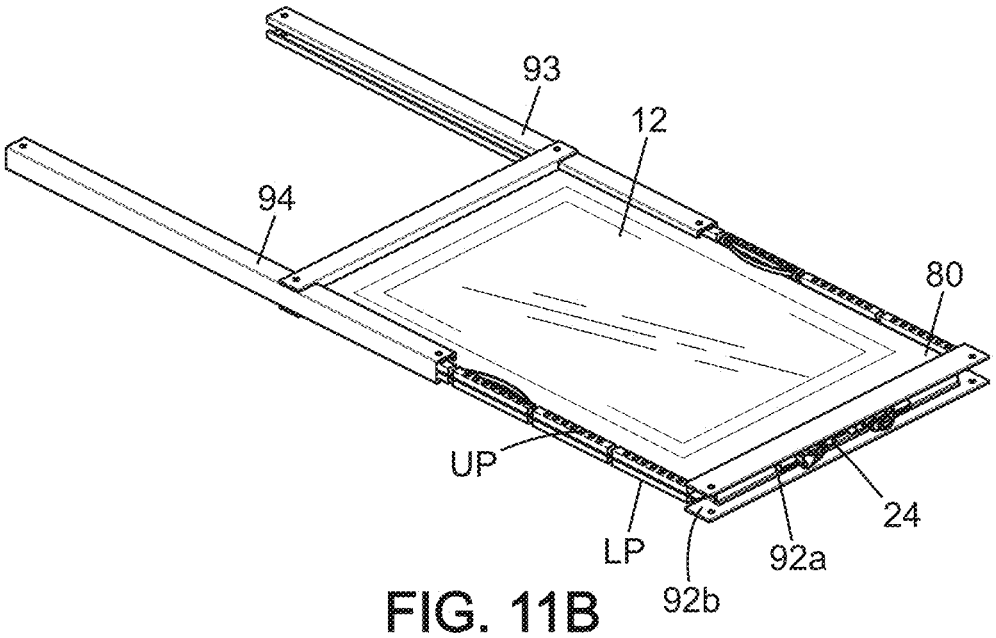
Figure 11C:
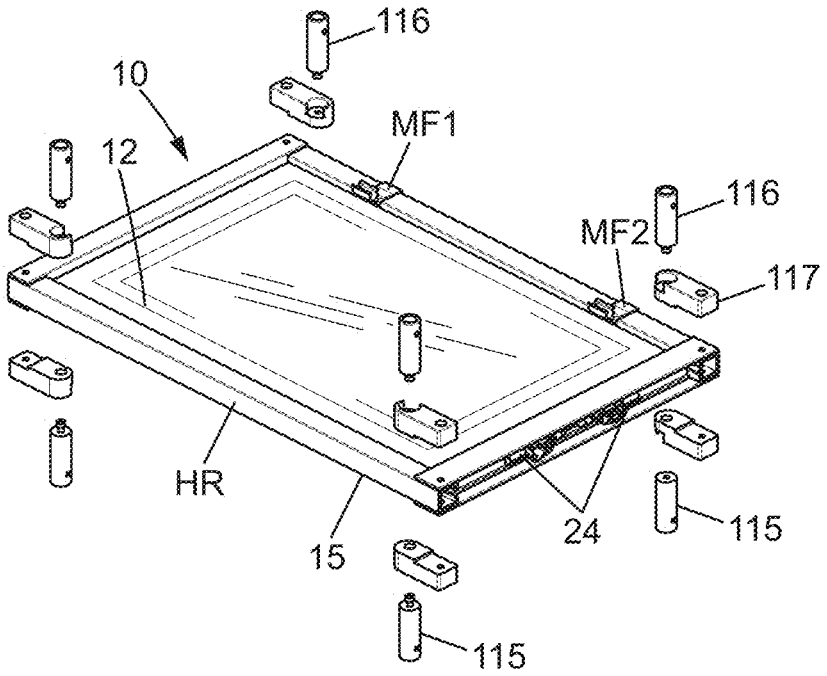

Use of four rigid profiles is here illustrated in FIGS. 11A-11C for forming the frame 15, which is of interest for forming a rectangular frame 15, efficient for protection purpose. Optionally, the pouch 2 may be of the Flexboy® type, and thus is a sterile, single-use, disposable container, adapted to be sandwiched by the protecting body and surrounded by the frame 15 obtained after assembling the profiles 91, 92, 93, 94 or similar holding elements.

In some options the holding and retaining assembly HR may have less than four members, so as not to form a rectangular frame. For instance, only three members may be sufficient, with a transverse member interconnecting two longitudinal covering parts 31, 32 parallel to the longitudinal axis A of the pouch 2. FIG. 3 only shows two covering parts 31, 32 that may be integral with feet or which may be associated to a transverse structure member. In some options, the covering parts 31, 32 may extend vertically. In the illustrated embodiments, the covering parts 31, 32 extend horizontally, which may be preferred when the pouch contains more than 50 L, for instance about 75 L or at least 100 L.

When the positioning members PM are part of the attachment system 18, the attachment system 18 can be considered as an assembly of several displaceable parts that can move inwardly relative to the frame 15. Here, the frame 15 comprise two elongated longitudinal supporting parts formed by two pieces or profiles 93, 94, that define each a housing for accommodating respective positioning members PM. At least one of the positioning members PM constitutes a slider movable inwardly inside the corresponding housing. Referring to FIGS. 10A-10B, it can be seen each lower part LP and an upper part UP are two separate pieces configured to sandwich the protecting body, in a sandwiching region of the peripheral margin 80. Each sandwiching region may be elongated, parallel to a protecting body edge, by extending longitudinally to be at least four times longer (with a length L8) than a maximal width W8 of the positioning members PM, as illustrated in non-limiting embodiment of FIG. 11A in particular.

Referring to FIGS. 10A-10B, all or part of the frame 15 forms a holding and retaining assembly HR. This assembly HR has surfaces BS1, BS2 for abutment of the positioning members PM, here provided in the two profiles 93, 94 that are exemplary pieces forming longitudinal supporting parts for supporting the protecting body provided with the fastening system 18.

More generally, it is understood that the frame 15 typically comprises abutment surfaces included and distributed in the two longitudinal supporting parts, all or part of the positioning members PM connecting the peripheral margin 80 to the frame 15 so that the frame 15 retains and supports:

the protecting body 12, 112, 212; and the pouch 2 that is sandwiched between the two plates 12A, 12B.

Some or all of the positioning members PM may constitute sliders, which are slidably mounted on or in the two longitudinal supporting parts, in order to be movable along a direction transverse to the longitudinal axis X1 (see FIG. 3 showing the axis of the protecting body, which may be merged with longitudinal axis A of the pouch 2), between:

a first position, in a non-filled-state of the pouch 2, in which the sliders are pushed outwardly or maintained away from the surfaces BS1, BS2 for abutment, by the protecting body 12, 112, 212 (when having its flat rectangular shape with a maximal perimeter), so that the sliders are able to be further displaced inwardly, and a second position, in a filled-state of the pouch 2, in which the sliders are each engaged against one of the surfaces BS1, BS2 for abutment.

In some options, positioning members PM may form guiding parts for receiving one or more body crossing members, screws or the like. Referring to FIG. 10A, an insertion piece IP may be provided in the positioning members PM, this piece IP being for instance a rod-like crossing members cooperating with a locking part, a nut or bolt. Of course, slots may be provided in the protecting body 12, 112 or 212, for allowing the body crossing members or any insertion piece IP to cross the peripheral margin 80 at a plurality of locations, thus stabilizing the positioning members PM (which remain integral with the peripheral margin 80, once assembled in this kind of embodiment). However, in preferred options, the positioning members PM may simply sandwich, with discontinuous distribution, the margin portions 8*a*, 8, while being unable to being disassembled once they are introduced in the frame 15, typically inside profiles 91, 92, 93, 94. Thus, there is no need for insertion piece IP and the margin portions 8*a*, 8*b* may be provided with boss portions B12, B12' or similar embossments for engaging with corresponding cavities of the positioning members PM.

Pouch Properties and Access for Filling or Emptying the Pouch

Referring to FIGS. 3-4 and 10A-10B, the pouch 2 may have a form or shape that is initially planar in empty state. The pouch 2 is flexible, in order to be inflatable, and may be made from a pair of flexible sheets (which form the respective walls W1, W2), having a rectangular or other plan form, and joined together at the four peripheral edges, to provide a containment volume (interior volume Q) between the sheets 21, 22, which are spaced by a spacing in a filled state. One or more openings or ports 24 may be provided, for example formed as closable tubes between facing parts of said peripheral edges of the sheet, to allow the pouch 2 to be filled or emptied.

In the illustrated embodiments, the protecting body 12, 112 preferably has an attachment system 18 for fastening the two plates 12A, 12B so that in an assembled state of the two plates, the protecting body 12, 112, 212 comprises a peripheral margin 80 that extends annularly in a protecting body reference plane P.

As shown in FIGS. 3 and 4 in particular, the peripheral margin 80 may be provided with at least one opening 80*a* able to receive at least one port 24 of the flexible pouch 2, for instance two ports 24. The protecting body 12, 112 may be provided with:

a first end side 120*a*, which is composed of the ends E1 of the two plates in the assembled state of the protecting body 12, 112, and a second end side 120*b*, which is composed of the ends E2 of the two plates in the assembled state of the protecting body 12, 112.

The one or more ports 24 may protrude axially outward from the second end side 120*b*. This arrangement with an opening 80*a* may be provided in any other version of the protecting body, in order to accommodate a flexible pouch 2 having one or more ports 24 (with flexible hose(s)).

Tubes T may be associated to the ports 24. Here, each of the tubes T is connected to the flexible pouch 2 by a port 24. Two front ports 24 may be provided. For example, one port 24 forms an inlet for the flexible pouch 2 and the other port 24 forms an outlet of the flexible pouch 2.

The pouch 2 is also designed to provide a high surface area/volume ratio at a thin thickness or spacing. By way of non-limiting example, a pouch 2 may have rectangular dimensions of about 600 mm by about 1300 or 1400 mm, and/or a holding volume of between about 10 liters and about 120 or 200 liters (preferably between 50 and 120 liters), and/or a spacing or pouch thickness (height along Z direction) of between about 8 or 10 mm to about 25 or 30 mm.

Each pouch 2 may be made from any suitable biologically compatible material, and which preferably facilitates heat transfer between the inside and the outside of the pouch 2. To reduce or avoid damage to the pouch 2 during cryopreservation due to the expansion of the biopharmaceutical material, it is preferred that the material would have a glass transition temperature that is below that of the biopharmaceutical material. By way of non-limiting example, each pouch 2 may be made from a multilayer composite material only made of thermoplastic material, for instance including polyethylene.

Tubing Holder

Referring to FIG. 4, the plates 12A, 12B of the protecting body optionally comprise an assembly 22 for holding the two tubes T associated to the two ports 24. The two plates 12A, 12B comprise, on their peripheral sides, complementary parts (complementary shape along Z direction, for instance) which form the assembly 22 for holding the tubes T.

The assembly 22 for holding the two tubes 16 is symmetrically arranged with respect to the longitudinal direction X (i.e. pouch longitudinal axis A which typically coincides with axis X1). Each symmetrical part is able to hold one tube T or hose.

In other options, especially suitable for accommodating pouches of high capacity (for example between 30 or 50 liters and 200 liters), the frame 15 may directly support at least one bracket or similar holding member, as illustrated in FIGS. 7-8, for holding the tubes T.

Referring to FIGS. 6-8, one or two hoses or tubes T are typically connected to a front edge of the flexible pouch 2. A rear edge of the flexible pouch 2, at a longitudinal end opposite to the front longitudinal edge, may extend substantially parallel to the front edge. While each tube T may be bent and have a length superior to length of the longitudinal sides LS1, LS2 of the pouch 2, any size of hose/tube may be used. Each tube T may be maintained substantially parallel to the protecting body reference plane P, by attachment to a tubing holder provided in or attached to the frame 15 of the assembly HR.

Each hose/tube T is provided with a connector 17 for fluid connection, typically a connection to another biopharmaceutical device. The connector 17 thus makes it possible to fluidly connect the flexible pouch 2 to another element, for example a tank. In storage position of the tube (s) by use of the fixation means MF1, MF2, each connector 17 may be located between the longitudinal rear side 120*b* of the protecting body 12 and the middle region MR.

Referring to FIGS. 6-8, one or more of the elongated profiles, here the profile 94, may be provided with one or more fixation means MF1, MF2 for supporting at least one tube T that is connected to the port 24 or included in the pouch 2 as an extension defining the port 24. The tubing holder, formed by the fixation means MF1, MF2, may be distributed at at least two spaced locations along a side of the frame 15, in a peripheral area of the system 1.

Referring to FIGS. 6A and 10, the fixation means MF1, MF2 may comprise at least one fixing element that can be snapped on the frame 15, here by engaging on the outer part of the rail-like profile of the frame 15. For instance, the fixing element is a bracket that partly surrounds a receiving profile, which may be one of the longitudinal profiles 93, 94 or another profile 91, 92. Some holes in the profiles may receive a pin or similar retaining inner protruding part of the bracket, for instance for an anti-sliding effect.

The bracket may be resiliently deformable, allowing removal of the fixing element relative to the frame 15, for instance by spacing the arms of the bracket further away. Accordingly, the tubing holder formed by the fixation means MF1, MF2 may be removed once line is no more used (inlet line not useful anymore after filling line disconnected).

Referring to FIG. 7 or 8, the tube T may be a filling line connected in removable manner to the pouch 2, for the purpose of the filling operation. For instance the tube T received and held/positioned by the fixation means MF1, MF2, is attached to the pouch 2 via a connector forming a quick seal connector.

The more the flexible tube T is away from the periphery of the system 1, the lower is risk for accidentally handling and disconnecting this hose or tube T, during transportation steps for instance. But, this tube T remains here easily available for operators.

The tubing holder may be an assembly for holding two tubes T, in order to be symmetrically arranged with respect to the longitudinal direction X (i.e. pouch longitudinal axis A). Each symmetrical part is able to hold one hose/tube T.

While FIGS. 6-8 show each a solution for horizontal storage, it is understood that the pouch 2 can also be stored vertically or along any suitable direction, thanks to a protecting device 10. A sliding structure may be used for having the protected pouch (in frozen state) carried by an annular frame or similar holding means that can extend vertically for storage purposes.

Protecting Body

Referring to FIGS. 1 and 3-4, the protecting body 12 or 112 comprises or consists in two plates 12A, 12B for protecting the flexible pouch 2. The plates 12A, 12B are entirely separate, here without hinging or connecting part. Typically, the plates 12A, 12B are two separable pieces. These pieces are relatively rigid, for instance sufficiently rigid so that they cannot form folding lines with bending angle of more than 45°. The plates 12A, 12B are thus configured to remain relatively flat. The protecting body 12, 112, 212 comprises a longitudinal axis X1 and has four sides 120*a*, 120*b*, 120*c*, 120*d*, the four sides comprising two longitudinal sides 120*c*, 120*d* extending parallel to the longitudinal axis X1 and two other sides that include a first end side 120*a*, and a second end side 120*b* each perpendicular to the longitudinal axis X1.

The protecting body 12 comprises two substantially planar plates 12A, 12B that are each made of a single thermoformed plastic piece. The planar plates 12A, 12B extend also in a plane parallel to the main plane XY (here parallel to the protecting body reference plane P). The plate 12A forms a lower surface S' and the plate 12B forms an upper surface S, with respect to the vertical axis Z. In preferred embodiments, the two plates 12A, 12B are identical and symmetrically face each other, with respect to the main plane XY.

The protecting body is a thin body, as the plates 12A, 12B may be compared to sheets of relatively low flexibility, the plates being made of same material. The thickness e of each plates 12A, 12B is lower than a minimal thickness of the positioning members PM. The plates 12A, 12B can have a general curvature but cannot easily folding (flexibility being substantially as low as PET).

While the illustrated embodiments show a protecting body 12, 112, 212 covering entirely the two main walls W1, W2 by the covering part 8, other size may be used for the covering part 8. For instance, the protecting body 12 could only cover a transverse band portion of each wall W1, W2, at a distance from the pouch edges 2A, 2B. Besides, one or more complementary protecting bodies could be used to cover at least one of the end parts of the walls W1, W2.

Referring to FIGS. 1 and 4, the protecting body 12 is also provided with an attachment system 18 for fixing the two plates 12A, 12B to each other. In FIG. 1, boss portions B12, B12' are provided for having the plates 12A, 12B fixed one to each other in removable manner, the boss portions forming interlocking forms with the outer projections of the first boss portions B12 delimiting hollows, in which the second boss portions B12' are received with plastic retaining contact. Here, the second boss portions B12' are projections (preferably hollow projections) protruding inwardly from the corresponding plate 12A or 12B. More generally, the plates 12A, 12B may be removably fixed to each other by an attachment system 18. Such system 18 may also be of the type that can be specifically seen (schematically illustrated) in FIGS. 2A-2B and 3.

Optionally, the attachment system 18 may comprise a plurality of snap buttons 20A, 20B. One of the two plates 12A, 12B comprises a first element 20A of one snap button and the other plate comprises a second complementary element 20B of one snap button. The second element 20B (possibly a male element) engages the first element 20A (possibly a female element) in a direction parallel to the vertical axis Z. Insertion pieces IP, for instance with screws or bolts may also be used, by crossing the peripheral margin at specific holes or slots S80 (see FIG. 2B).

Alternatively, the attachment system 18 is a non-removable system, which means that, once the two plates 12A, 12B are fixed to each other, it is not possible anymore to detach the two plates 12A, 12B one from each other. Clips may be used for such non-removable fixation.

In the non-limiting embodiment of FIGS. 2A-2B and 4, the protecting body 12 comprises snap buttons on transversal sides 120*a*, 120*b* and on the two margin portions 8*a*, 8*b* (typically between the covering part 8 and the longitudinal sides 121, 122). More generally, each of the two plates 12A, 12B is provided with complementary members. Typically, the two opposite margin portions 8*a*, 8*b* may be considered as part of a fastening assembly provided to prevent any shifting in position between the two plates 12A, 12B once they are mutually fastened at least in the two margin portions 8*a*, 8*b* of the peripheral margin 80.

As can be seen in FIGS. 5 and 8, when the two plates 12A, 12B are fixed to each other, they sandwich the flexible pouch 2. The planar plate 12A, which forms the lower surface of the protecting body 12, presses the lower surface of the flexible pouch 2, with respect to the vertical axis Z. Similarly, the planar plate 12B, which forms the upper surface of the protecting body 12, presses the upper surface of the flexible pouch 2, with respect to the vertical axis Z. The two plates 12A, 12B have planar dimensions which are substantially identical to the ones of the flexible pouch 2, with typical difference that ribs may be provided on the outer surfaces of the plates 12A, 12B.

Exemplary Ribbing Patterns

In each plate 12A, 12B, a group of ribs is provided with ribs R1, R2, R2',800 arranged close to the peripheral margin 80. An optional other group of ribs may be provided with ribs R3, R4, 83, 84, 85, 86 arranged at a greater distance from the peripheral margin 80. Such ribs R3, R4, 83, 84, 85, 86, which can be considered as ribs of a first group, may surround one or two panel portions PP, PP1, PP2, which are typically forming rectangular panels, in each outer surface S, S' of the protecting body 12, 112.

Referring to FIG. 1, the plates 12A, 12B may have each a panel portion PP. For instance, the panel portion PP extends between:

ribs (front ribs) close to a front side provided with the opening for the one or more ports 24, and ribs (rear ribs) arranged at the opposite from the front side.

Each panel portion may be strictly planar before assembling, possibly except at few local projections, here except at two projections 12*p*, which can be protruding (outwardly) in same direction as the ribs. The projections 12*p* can be used to support a temperature sensor. These projections 12*p* may be median projections, intersected by a median plane of the protecting body 12 which extends along Z direction, parallel to a width of the protecting body 12. The projections 12*p* may be disposed at the rear of any one of the front ribs and at the front of any one of the rear ribs.

More generally, the ribs may be distributed in groups, a first group of which having ribs R3, R4, 83, 84, 85, 86 extending annularly (possibly with square or rectangle shape with curved corners), typically in the peripheral annular region 8*p* of the covering part 8 as they are outside any panel part PP or PP1, PP2, while a second group of ribs has ribs R1, R2, R2',800 extending parallel to the first group of ribs and arranged closer to the peripheral margin 80 as compared to the first group.

Here, it is seen that several transverse ribs portions may be provided, separating the short margin portion of the peripheral margin 80 from one of the panel part (panel PP1 or PP2). At least six or eight transverse ribs thus may be provided and distributed at two opposite ends of each plate 12A or 12B. Referring to FIG. 5B, it can be seen that grooves G' (and transverse groove portion thereof as well) surrounding a panel PP1 or PP2 may be narrower than grooves G delimited by side ribs R1 and/or 82. They may typically be narrower and less deep than grooves G or transverse portions thereof delimited by the transverse rib portions RP1, RP2.

In the illustrated embodiments, the protecting body 12, 112, 212 preferably has an attachment device/system 18 for fastening the two plates 12A, 12B so that in an assembled state of the two plates, the protecting body 12, 112 comprises a peripheral margin 80 that extends annularly in a protecting body reference plane P as illustrated in FIGS. 3 and 4. In some options, the peripheral margin 80 that extends in an interior interspace delimited by the frame 15 is typically a margin without ribs. In variants, one or more ribs R1 adjacent to the margin part for mutual attachment of the plates 12A, 12B may extend in such interspace.

The protecting body may be provided with:

a first end side 120*a*, which is composed of the ends E1 of the two plates 12A, 12B in the assembled state of the protecting body 12, 112, 212, and a second end side 120*b*, which is composed of the ends E2 of the two plates in the assembled state of the protecting body 12, 112.

The one or more ports 24 may protrude axially outward from the second end side 120*b*. Here a part of the pouch front edge is thus accessible.

In empty state of the pouch 2, the two plates 12A, 12B respectively form a first surface S' and a second surface S of the protecting body 12, 112 covering the pouch 2. When having a substantially horizontal configuration, the first surface is a lower surface and the second surface is an upper surface. The fastening members 146, 147, 148 can be provided on one of these surfaces S, S' near an end side chosen amongst the first end side 120*a* and the second end side 120*b*.

At least one amongst the lower surface S' and the upper surface S may be a surface having a plurality of ribs distributed in two opposite parts of the surface, which are longitudinally opposite parts. Preferably, the ribs of this plurality include first transverse rib portions 4 proximal to the first end side 120*a* and second transverse rib portions 6 proximal to the second end side 120*b*.

More generally, such transverse rib portions 4, 6 or RP1, RP2 provide an accordion effect due to width of the corresponding grooves G1, G2 formed by the ribs and/or height of the ribs (depth of the grooves G1, G2). This facilitates local expansion of the plates 12A, 12B despite the planar structure of the peripheral margin 80 forming the protecting body reference plane P. Typically, in corner regions CR, the first and second transverse rib portions 4, 6 have a height decreasing with decreasing space from the corner vertices of the plate having such rib portions 4, 6. Accordingly, too great expansion that could create undesirable folds (along diagonal lines) may be limited or prevented when having height reduction for the corner rib portions, extending in the corner regions CR. In other words, accordion effect may be practically reduced in the four corner regions CR in each plate 12A, 12B. More generally, structuring of the plates 12A, 12B, using first and second transverse rib portions 4, 6, is helpful, in order to facilitate spreading of fluid toward the margin 80 and toward the corners of the protecting body 12, 112 when filling the flexible pouch 2 sandwiched between the plates 12A and 12B.

This is of interest, in order to have or improve a belly retention effect. Indeed, the more the fluid can be distributed toward the four corners, the less bulged is the pouch 2 in a middle region. The protecting body 12, 112 is typically able to move in interspaces of the holding and retaining assembly HR, as described in more detail below. Besides, the structuring effect of the ribs may prevent folding lines to form substantially along the diagonals DL1, DL2, when difference in thickness/expansion between the middle region including the center C of the protecting body and the covering portion edges is too pronounced.

Some detailed embodiments of a protecting body 12 or 112 provided with a ribbing pattern will be described hereinafter.

The plates 12A, 12B as illustrated in FIGS. 1, 2, 4 and 7 correspond to a first embodiment of the protecting body 12, in which several ribs are provided. In each outer surface of the plate, the ribs are provided so that the inner face is provided with grooves. Some grooves G1, G2, such as shown in FIG. 1, are including transverse groove portions extending perpendicular to the longitudinal axis X1 and close to the opposite end sides 120*a*, 120*b* of the protecting body. An annular rib R1, protruding upwardly in the outer surface S or S', may be provided to define the groove G1 which is of annular shape on the plate interior surface. Two separate ribs R2, R2' protruding upwardly in the outer surface S or S', may be provided to define the two grooves G2 which are each of annular shape on the plate interior surface.

Thanks to the ribs R1 and R2, R2', a pair of transverse rib portions 4, 6, here parallel to Y-axis direction (perpendicular to the longitudinal axis X1) may be arranged close to the respective end sides 120*a*, 120*b*. In other words, these ribs form the first transverse rib portions 4 proximal to the first end side 120*a* and the second transverse rib portions 6 proximal to the second end side 120*b*.

Referring to FIGS. 1-2, it can be seen that each plate 12A, 12B may be rectangular with four corner regions CR, two virtual diagonal lines DL1, DL2 (diagonal lines of the plate) intersecting each a pair of corner vertices of the four plate corners. More precisely, each of the two virtual diagonal lines DL1, DL2 intersects:

a first series of corner ribs C1, C2 proximal to the first end side 120*a* and protruding outwardly along a direction perpendicular to the protecting body reference plane P, and a second series of corner ribs C1, C2' proximal to the second end side 120*b* and protruding outwardly along a direction perpendicular to the protecting body reference plane P.

Each of the corner ribs C1, C2, C1', C2' is curved and connects two rib portions that are perpendicular one to each other. Here the annular rib R1 thus may include two pair of corner ribs C1, respectively C1'.

It can also be seen that the ribs may be provided with differences in height so that they protrude more or less outside. For instance, the transverse rib portions 4, 6 included in the ribs of annular shape or U-shape R1, R2, R2',800 may be of increasing height (maximal height) with the decreasing distance to the peripheral margin 80. Typically, the ribs very close to the peripheral margin 80 may have a progressive rounding (with greater radius of curvature) in their profile as viewed in cross section of the rib. Such ribs close to the peripheral margin 80 may also prevent waves or radial folds along angled/diagonal directions to be created in the plates 12A, 12B.

As such rib height may relatively great near the junction with the peripheral margin (thus locally allowing a greater slope effect), other ribs of lower height (possibly more rigid) may be provided around the panel PP, PP1 or PP2, to have expansion of the plates 12A, 12B that remain substantially parallel to the protecting body reference plane P.

Figure 12:
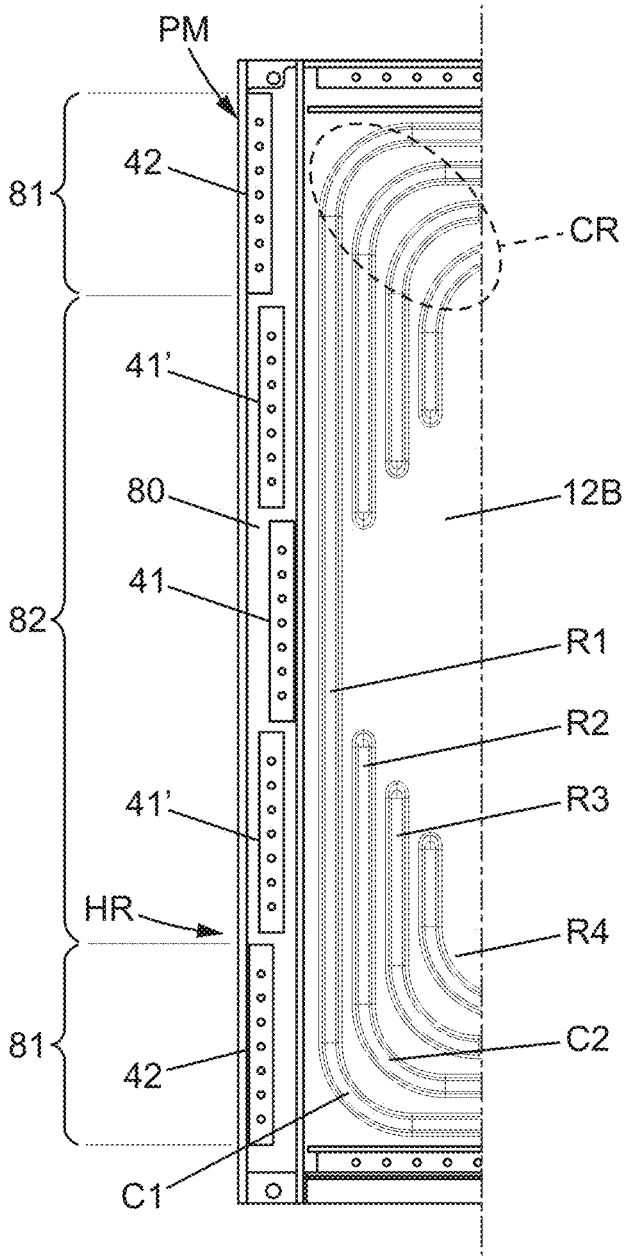
FIG. 12 illustrates a detail of an exemplary distribution of positioning members provided for holding/maintaining a same longitudinal side of the peripheral margin of the protecting body, allowing limiting bulge effect in a middle region of the protecting device in filled state of the flexible pouch.

Besides, as the pair of U-shaped ribs R2, R2' are separated, the same applying for the optional ribs 800, also U-shaped, there is no additional rib in the middle region MR at equal distance from the front and rear ends E1, E2. Avoiding multiple longitudinal ribs in the middle/edges of the protecting body 12 is here preferred as having too many or too significant/pronounced ribs could cancel benefits of a belt effect made by stoppers 41 such as illustrated in FIG. 12 (the belt effect is explained in more detail below). If present, such longitudinal ribs would then allow the expansion of the protecting body 12 in its center (bulge effect as in FIG. 6).

Referring to FIG. 8, at an ending stage of the filling with more than 60 or 70% of full capacity reached, expansion of each plate 12A, 12B may be obtained with slope as reduced as possible at each panel, here at the panels PP1 and PP2, if a belt effect is produced. As pushing force of the liquid becomes relatively high, there is side expansion due to accordion-effect at the longitudinal rib portions 110 and at the transverse rib portions 4, 6, RP1, RP2. Such accordion-effect facilitates circulation of liquid toward the edges rather than accumulating in the middle region M. The transverse rib portions 114 along the middle section MS also participate in preventing the liquid from accumulating only in a middle region.

In corner regions CR, the height may be significantly lower than in the transverse rib portions 4, 6 formed by the ribs R1, R2, R2',800, which may be of interests for not impairing integrity of the plates. Besides, having here lower height in the ribs may allow having a transition as smooth as possible between elongated sloped portions SP formed along the long sides of the peripheral margin 80 and the elongated transverse sloped portions SP' formed along the short sides of the peripheral margin 80.

It can also be seen that the ribs are provided in the thin regions of the protecting body once the pouch 2 has been filed, so that these ribs R1, R2, R2',800 extend perpendicular to the slope considered along Z direction. With such orientation, the parallel ribs can expand in accordion manner, with provision that the pouch 2 is filled at a sufficient level (for example filled more than 60% or 70% of the full capacity) as the content should provide sufficient internal pressure to push the ribs from inside.

Figure 14A:
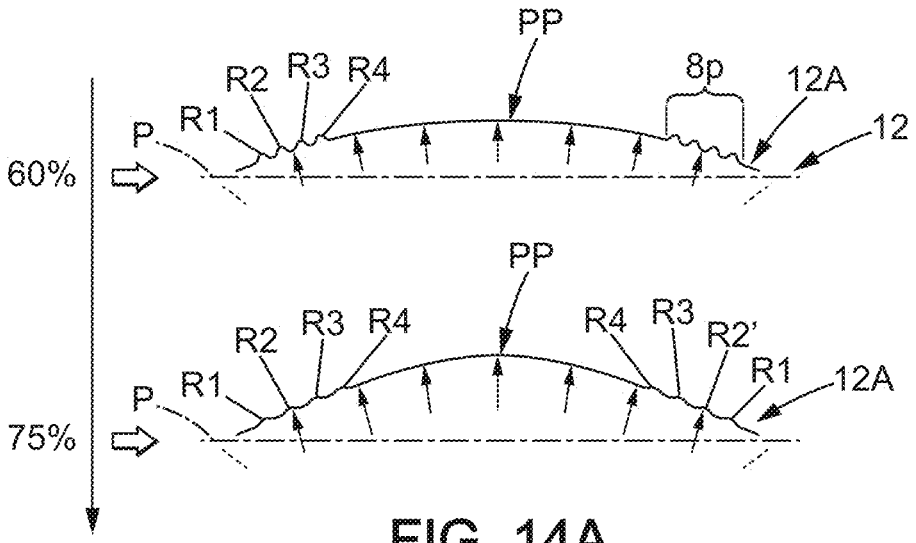
FIG. 14A schematically illustrates evolution of a plate profile at different filling levels (the pouch being not illustrated), with rib portions helping in spreading more liquid toward the edges.

Referring to FIG. 14A, it can be seen that a ribbing is of interest for guiding the liquid (biopharmaceutical composition Q) toward the corners at least when the internal pressure is sufficient to slightly deform the grooves G1, G2 delimited by the ribs R1, R2, R2'. In this exemplary embodiment, the wavy profile formed by the (accordion-like) ribs R1, R2, R2', R3, R4 is present near/on the edges of the covering part 8 so that the plates 12A, 12B can be stretched in these areas under the pressure of the pouch filling:

a) When the pouch 2 (here of about 100 liters capacity) is filled to 60 L nothing significant happens in the peripheral annular region 8*p* of the cover part 8 (see top of FIG. 14A), as the pressure is still insufficient to have the ribs deformed;

b) When the pouch is filled to 75 L, the accordion-like arrangement of the ribs R1, R2, R2', R3, R4 will stretch under the pressure of the pouch filling and the plate 12A will stretch even more in its center, if no belt effect is provided.

It thus shows that the arrangement of the ribs is of interest to delay/relatively reduce the increase in stretching, which causes higher filling at the panel part PP and lower filing outside the panel part PP.

Figure 14B:
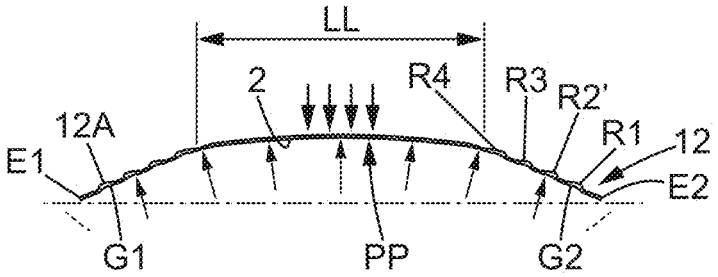
FIG. 14B shows a synergetic effect of combining a ribbing pattern and a belt effect for a high level of filling of the pouch.

Referring to FIG. 14B, it is also shown a profile (which may be similar, along XZ or YZ plane) of the ribs for a high level of filing, here with the pouch 2 filled with at least 75 L. If the edges of the middle of the margin portions 8*a*, 8*b* are narrowed or provided with early stoppers 41 to limit shrinkage (belt effect), the accordion arrangement of the ribs R1, R2, R2', R3, R4 of the protecting body 12 (and same applies with similar ribbing patterns, such as in the embodiment of FIG. 3) will stretch under the filling pressure of the pouch 2 and the panel part(s) of the protecting body 12 will be kept more flat, as each panel part lengthens (along Y direction toward the margin portions 8*a*, 8*b* and along X direction toward the ends E1, E2), thus minimizing size along Z-direction in the middle of each plate 12A or 12B.

The ribs R1, R2, R2', R3, R4 may each be delimited by straight edges, in order to define respective virtual rectangles. Besides, the ribs R1, R2, R2', R3, R4 may extend around a panel part PP of the plate 12A, 12B, with such panel part PP having a transverse size TL which is equal or superior to half the width T12 (transverse size) of the plate 12A, 12B, as illustrated for example in FIG. 2B. The same typically applies for embodiments with ribs 110, 83, 84, 85, 86 arranged around a panel part PP1 or PP2, with each panel part PP1 or PP2 having a transverse size TL which is equal or superior to half the width T12 (see for instance FIG. 5C).

Here, the length LL (longitudinal size) of the panel PP is also much greater than half the total length of the plate 12A, 12B. When having two panels PP1, PP2, cumulated longitudinal size of the two panels PP1, PP2 may also be superior or equal to the total length of the plate 12A, 12B. More generally, it is of interest to have cumulated panel length(s) exceeding half of the plate length.

Still referring to FIG. 14A, it is understood that the section view where such profile is obtained can correspond to a plane parallel to YZ direction, preferably away from the middle section MS. In the middle section MS, the number of longitudinal ribs portions (along X direction) can be minimized due to a clearance region, in order to not interfere with a belt effect. In some options (less preferred), the plates 12A, 12B may sandwich the pouch 2 without any belt effect, for instance if the pouch 2 has not to be filled at its full capacity.

In some embodiments, all or part of the longitudinal rib portions are removed and only transverse rib portions 4, 6, RP1, RP2 are present in at least one of the plates 12A, 12B. These transverse rib portions 4, 6, RP1, RP2 are already efficient to have more liquid stored in the two opposite ends adjacent to the short margin portions of the peripheral margin 80. The more liquid can be stored near the corners and the short sides, the lower is the thickness of the protecting body 12, 112.

The following table shows impact for the size along Z direction, when using some ribbing patterns in the plates 12A, 12B, each time with same belt effect using a configuration of positioning members PM such as in FIG. 11A or 12. The size as indicated below is/reflects the maximum thickness of the protecting body, not in frozen state. In frozen state, the belly size may increase by approximately 25%.

| Kind of ribbing | Percentage of filling (for a pouch of 100 L capacity) | Belly size (along Z direction) in mm |
|---|---|---|
| Without any rib (flat plate; FIG. 6) | 100% | 270 |
| With U-shaped ribs in each halve (FIG. 1) | 75%<br>about 85% * | 196<br>235 |
| With rectangular ribs of in each halve (FIG. 3) | 75%<br>about 85% | 178<br>260 |

It can be seen that the U-shaped ribs (here ribs R2, R2' and R3, R4) are especially efficient at the end of the filling, when the pouch 2 sandwiched by the plates 12A, 12B is filled at more than 75%. For this reason, the minimum size along Z direction is obtained with this ribbing pattern. In similar embodiments, less U-shaped rib portions may be used, as illustrated in FIGS. 11A-11C for instance. It is understood that, if compactness with a size less than 220 mm is wanted for sake of compactness, the pouch filling level will be too low (about 55 liters only for instance for a pouch of 100 L) in absence of any suitable ribbing for helping in having liquid near the edges, i.e. near the clamping areas. In contrast, the protecting body 12 with the ribs R1, R2, R2' and R3, R4 is typically suitable for containing at least 88 or 90 liters for a 100 L pouch before freezing.

Regarding situation with a pouch filled at lower level, for instance about 70 or 75% or less, the ribs such as shown in FIG. 3 are more efficient to limit bulge effect in the middle region MR. For maximal filling, the ribs of this embodiment have less added-value as it is firstly the belt effect that limits the bulge total size below 300 mm. In practice, 75% filling may be considered sufficient, as further expansion due to freezing is typically anticipated.

When analyzing the bulge effect such as shown in FIG. 6, it can be seen that a relatively low angle is obtained for the sloped portions adjacent to the peripheral margin 80. Indeed, these portions are close to the attachment system 18, thus near clamping areas. It is here observed that the protecting body plates are more difficult to be deviated from the planar reference P, as if they were more rigid, at/near the edges because such peripheral areas are near the clamping areas (shorter lever arm).

A high part of the biopharmaceutical product mass is concentrated in the middle of the covering part 8, even if the pouch 2 is filled only at 75% of its full capacity. Here, the plates of the protecting body 212 are not submitted to any belt effect on the one hand, and there is no ribbing for helping in having narrower sloped portions and/or homogeneous slope (without interfering folds) on the other hand. The solution illustrated in FIG. 7 or in FIG. 8 is of interest to have a better distribution of the biopharmaceutical composition Q relative to the whole lower surface S' of the protecting body 12, 112, with such fluid more present in the corner areas.

Referring to FIGS. 3, 5A-5D and 8, it is shown an example of a protecting body 112 having at least one plate 12A, 12B provided with two panels PP1, PP2. While embodiments of FIGS. 1, 2A-2B show ribbing patterns, in which the ribs may be considered as peripheral ribs (all extending parallel to the peripheral margin 80, i.e. along a circumferential direction), arranged around a central panel portion PP of the plates 12A, 12B, FIGS. 3 and 8 show that some ribs or rib portions 114 may be provided in a middle region MR, possibly extending transversally to separate two panels PP1, PP2 of a same plate 12A or 12B.

The rib portions 114, forming middle ribs in this embodiment, may be suitable to obtain a kind of "camel back" shape, once the pouch 2 is in a filled state. Some simulations have been performed to confirm this is efficient to limit total thickness of the protecting body, for pouches filled with 75 or 100 liters of liquid biopharmaceutical composition Q. Practically, the ribs of this pattern have a kind of molding effect so as to get two small off-center bellies rather than a greater mass of product in the middle section MS.

Transverse rib portions RP1, RP2 mays also be formed at opposite ends of the cover part 8, these rib portions possibly being interconnected to the longitudinal rib portions 110 by smaller corner ribs C1 provided in the corner region CR. In some options, no corner rib is present. Referring to FIG. 5D, The middle 110*a* of the longitudinal rib portion 110 has here a minimum in height H1' lower than a maximal height H1 of the longitudinal rib portions 110 that is found away from the middle region MR where a belt effect can be performed thanks to early stopping positioning members PM specifically provided in middle of the corresponding margin portions 8*a*, 8*b*. The difference H1-H1' may be at least equal to 2 or 3 mm.

Figure 5A:
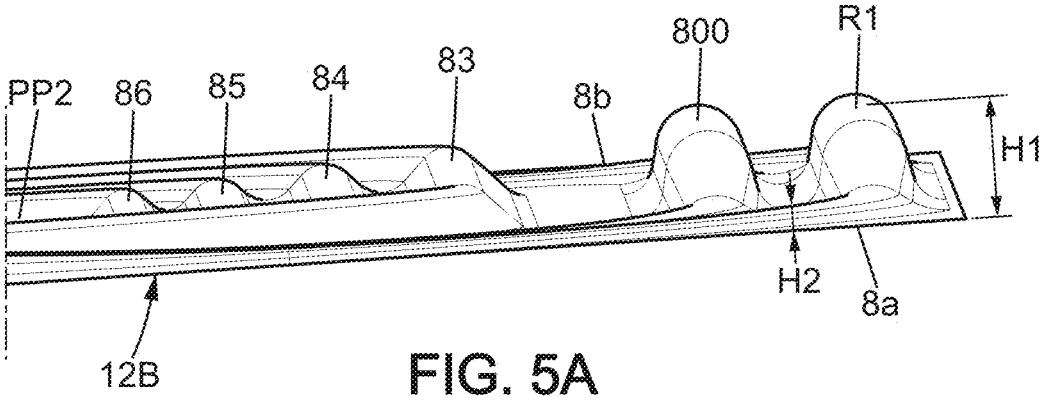
FIGS. 5A, 5B, 5C, 5D show respective details of reliefs provided in a plate such as included in the system of FIG. 3 and used to form a storage unit in accordance with a second embodiment of the invention.
Figure 5B:
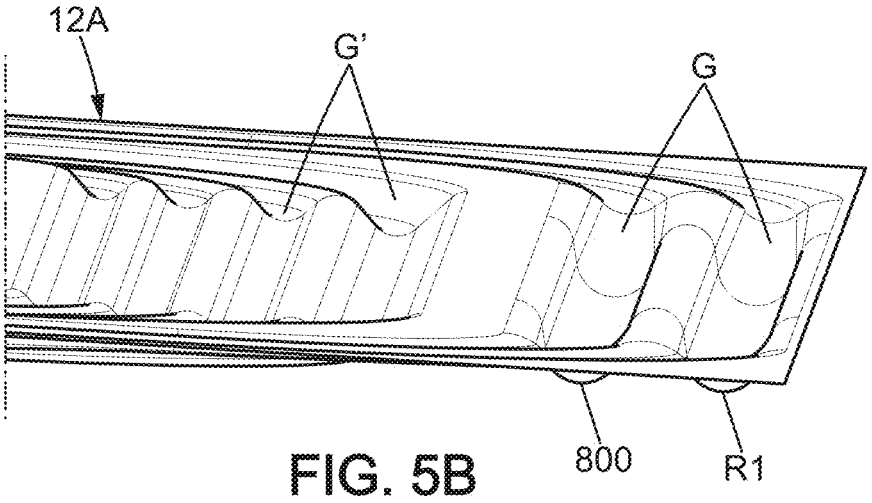
Figure 5C:
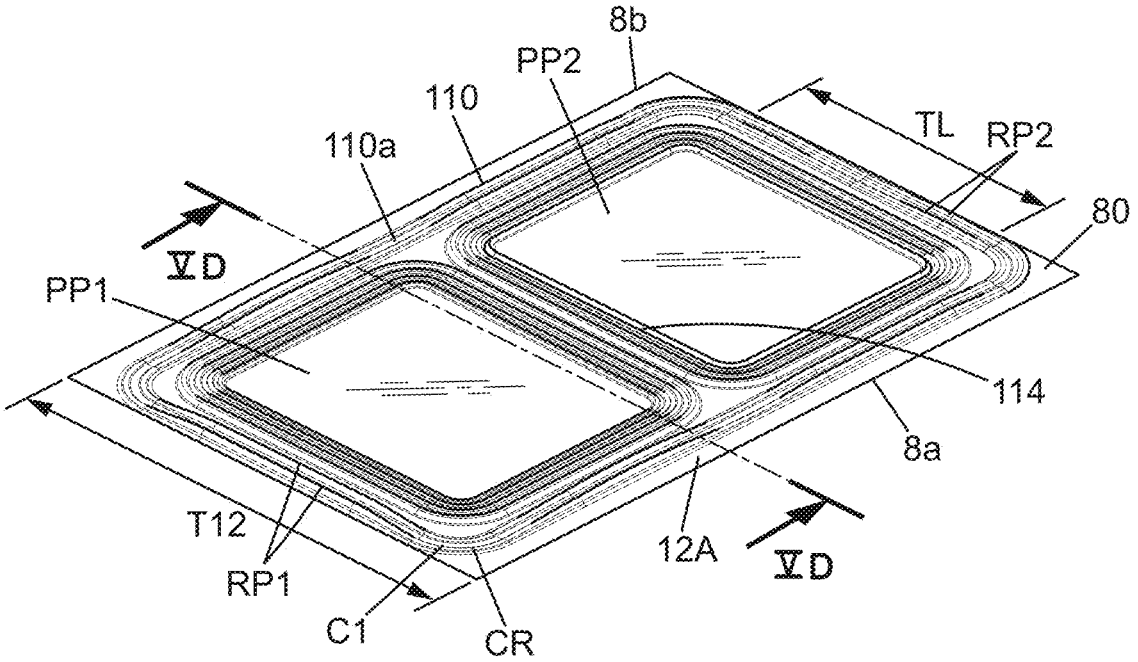
Figure 5D:
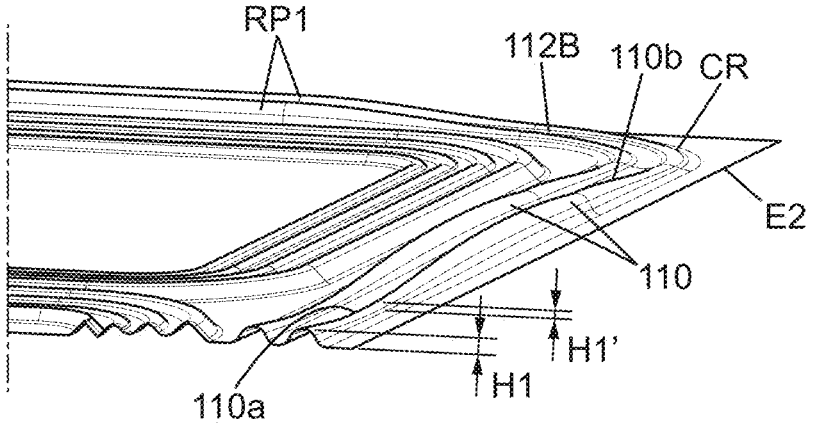

Now referring to FIG. 5A, the corner regions CR may be provided with less relief. Here, the maximal height H2 in the corner regions CR may be equal or less than half the height H1 that is obtained at the longitudinal rib portions 110 and/or at the transverse rib portions of the outermost side rib R1. With such arrangement, possible fold lines will be limited and only created in the corner regions CR, along diagonal lines DL1, DL2, thus corresponding to "desirable" fold lines, i.e. not interfering with expansion of panel part(s) parallel to the protecting body reference plane P.

In the illustrated embodiments, each of the two virtual diagonal lines DL1, DL2 may intersect: a first series of corner ribs proximal to the first end side E1, and a second series of corner ribs proximal to the second end side E2 and protruding outwardly. Each of the corner ribs are curved and are connecting two rib portions that are perpendicular one to each other. Typically, the first transverse rib portions 4 are directly connected to the corner ribs of the first series, while the second transverse rib portions 6 are directly connected to the corner ribs of the second series.

Besides, the first transverse rib portions 4 and the second transverse rib portions 6 may extend perpendicular to the longitudinal axis X1 and belong to an intermediate region between two corner regions CR respectively adjacent to an intersection of two of the four sides. Preferably, each corner region is elastically more deformable than such intermediate region provided with transverse rib portions. Typically, each of the corner regions are more deformable than any one of the side regions provided with longitudinal rib portions 110.

A symmetrical ribbing may be preferred. For instance, ribs in the lower surface S' is distributed in two halves of the plate forming the lower surface S', and/or the pattern of ribs in the upper surface S is distributed in two halves of the plate forming the upper surface S. While same ribbing pattern is provided in the two complementary plates 12A, 12B according to the illustrated drawings, some differences may be provided in variants. Optionally, one of the plates may be deprived of ribs.

The plates 12A, 12B form each a stiffening layer when overlapping, and preferably entirely covering, the main walls W1, W2. The thickness e of each plate 12A, 12B before Thermoforming may be of about 1.27 mm and thus may be lower than 2 mm, with provision that the plastic material of the plates has a density superior to 1.10 g/cm$^3$, preferably superior to 1.15 g/cm$^3$ (typically without being above 1.5 or 1.6 g/cm$^3$). Plate material may have a tensile strength at break, which is typically between 45 and 75 MPa, for example in the range 50-60 MPa, typically 52-59 MPA (standard test ASTM D638). Plate material may have a tensile strength at break between 45 and 60 MPA and a Young's Modulus comprised between 1250 and 1550 MPa, both along transverse direction (TD) and machine direction (MD).

Shrink Management

The flexible pouch 2 can inflate during filling operation, which means that the circumference of two main walls W1, W2 as considered in the pouch plane is decreasing due to inward movement, also known as shrink stroke, of the different sides. Here, in horizontal configuration of the system 1 as illustrated in FIGS. 6-9, four pouch sides can be displaced inwardly due to the vertical expansion (along Z-axis).

The holding and retaining assembly HR, which may include a rectangular frame 15 or at least two longitudinal covering parts 31, 32, is arranged to maintain two longitudinal margin portions of the peripheral margin 80, and allowing the two plates 112A, 112B moving, extending, and shrinking in a transverse direction belonging to the protecting body reference plane P. The two longitudinal covering parts 31, 32 may comprise two profiles 93, 94 each delimiting an interior cavity CP. In non-limiting embodiments, the interspaces may be respective interior cavities CP of such covering parts. Each of the two longitudinal covering parts 31, 32 may include a profile having a C-shape to delimit one of the interior cavities CP.

Now referring to FIGS. 9, 10A-10B, 11A, 11B, 11C and 12, it will be described exemplary embodiments for forming the positioning members PM as stoppers preventing too great inward displacement of some regions of the peripheral margin 80, when the pouch 2 is more and more filled.

The positioning members PM may be adapted to cover the boss portions B12, B12' such as illustrated in FIG. 1 or similar embossments. For instance, the positioning members may include several cavities each housing a respective pair of boss portions B12, B12'. With such arrangement, there is no need for aperture or through-hole in the margin portions 8*a*, 8*b* of the plates (only one hole may be provided for the at least one port 24, at a front end of the protecting body).

Typically, the frame 15 may house the margin portions 8*a*, 8*b* sandwiched by a plurality of discontinuous positioning members PM. Along Z direction (see FIG. 1), the depth of each hollow delimited by a boss portion B12 or B12' (such depth defining a stroke for disengagement between the complementary boss portions B12 and B12') may be superior to maximum spacing, measured along Z direction, between the frame 15 and any one of the positioning members PM. In such option, the frame 15 thus extends above and below each of the positioning members PM and prevents disassembling of the respective pairs of boss portions B12, B12'.

Here, the frame 15 is provided with abutment surfaces BS1, BS2 included in abutment members or rims. Each abutment members may delimit an inner access to a housing, in which the positioning members PM extend. Typically, each profile 91, 92, 93, 94, forming a side of the frame 15 may be provided with an open end suitable for introduction of a respective side of the protecting body 12, 112, 212 inside the housing (side chosen amongst the four sides). The inner open sides of the frame 15 are not used for assembling or disassembling steps, due to presence of the abutment members that prevent any possibility for the positioning members PM to be inserted inside or extracted outside the profiles 91, 92, 93, 94 through the inner open sides. Indeed, at an inner face of each profile 91, 92, 93, 94, there is at least one abutment member BS1, BS2 extending transversely relative to the protecting body reference plane P. Here, each profile 91, 92, 93, 94 has a C-shape section, with the opening of the inner open side delimited between two vertically spaced abutment members. Each abutment member is here a continuous member elongated along length of the corresponding profile. But in variants, the abutment members may be divided into separated abutment regions or constructed in any suitable manner, without interfering with the protecting body reference plane P.

Here, as illustrated in FIGS. 11A and 11B in particular, the positioning members PM are inserted by sliding insertion along a direction parallel to the long side of the profile 91, 92, 93 or 94 in which they are housed. The positioning members PM may thus be inserted at the rear of abutment members and remain at the rear of the abutment members (forming the surface BS1, BS2) in assembled configuration of the frame 15 around the protecting body 12, 112, 212.

Referring to FIGS. 11A-11C, each longitudinal supporting part, typically under the form of a profile 93, 94 or similar piece, delimits one or more housings and is assembled with at least one adjacent supporting part (for instance two transverse supporting parts), also possibly under the form of a profile 91, 92. An annular housing may be included in the frame 15, when the profiles 91, 92, 93, 94 are assembled, possibly using lower feet 115 and/or upper feet 116 for supporting another frame 15. For instance, the two profiles 93, 94 respectively define a first housing and a second housing, in which the sliders are mounted.

Here, it can be seen that the sliders may comprise:

first sliders fitted in at least one cavity CP delimited by the first housing; and second sliders fitted in at least one cavity CP delimited by the second housing.

Referring to FIGS. 9, 11A and 12, it can be seen that the sliders in the first and second housings will act as stoppers, more particularly either early stoppers 41 if mounted in a inwardly shifted manner on the peripheral margin 80, or late stoppers 41',42 engaging abutment members at the surfaces BS1, BS2 at a later stage during filling of a pouch 2. The front surface BS of the early stoppers may possibly be already engaged, for a non-filled state of the pouch 2, onto one or more of the abutment members or rims provided in the frame 15, here in a middle region MR.

Referring to FIG. 11A, each transverse supporting part, here formed as a profile 91 or 92, is configured for housing additional sliders, at least a part of which is acting as early stoppers. The front surface BS' of the early stoppers (orientated toward the pouch 2) may possibly be already engaged, for a non-filled state of the pouch 2, onto one or more of the abutment surfaces provided in the frame 15, here in transverse profiles 91, 92 or similar transverse supporting parts of the frame 15.

In the illustrated embodiments, all or part of the positioning members PM are configured to slide and thus form sliders able to be displaced inwardly with increasing filling level of the pouch 2, as illustrated in FIGS. 10A-10B. For a filling lever of more than 70 or 75% for the pouch 2, the angle $\alpha$ of the slope defined at the surfaces S and S', relative to the reference plane P, may be constant along the long sides, and possibly higher when having ribs 110 whose height is greater than plate thickness to provide an accordion effect; preferably maximal height H1 of plate ribs may be greater than 3 mm with a rounded profile, such height being preferably lower than or equal to groove width (width of groove being width of the hollow which separates two interior edges of the corresponding rib). Here such ribs 110 extend longitudinally.

Typically, width of each groove G1, G2, G may be superior to 10 or 12 mm, preferably inferior or equal to 35 or 40 mm. In embodiments, any of the ribs formed along X or Y direction may have a width superior to 10 or 12 mm, while forming an elongated hollow/groove having an interior width of at least 10 mm.

Referring to FIGS. 11A, 11B and 11C, a first group of the positioning members PM are distributed longitudinally in the frame long sides, while a second group of the positioning members PM are placed along transverse areas of the peripheral margin 80 and distributed in the frame short sides. When members PM, which typically form sliders housed in the profiles 91, 92, are mounted on transverse profiles or similar supporting parts, they are each slidably mounted and can move along direction of the longitudinal axis X1.

The frame 15 has here a rectangular shape thanks to the two longitudinal supporting parts and the transverse supporting parts. It is thus understood that the frame 15 can comprise abutment surfaces BS1, BS2 included and distributed in the two longitudinal supporting parts and in at least one of the transverse supporting parts.

The positioning members PM, forming sliders in the frame 15 and assembled such as shown in FIG. 11A-11C, are suitable to allow shrink management, while using rigid material (aluminum) compatible with low/negative temperatures.

Details of Exemplary Embodiments for Controlling Pouch Expansion

In embodiment of FIGS. 7-8, the plate dimension reduction (as considered in XY plane) may be obtained with a profile of shrink strokes, such reduction being adjusted to be different, depending on longitudinal positions of some positioning members PM that locally prevent or limit such dimension decrease, for a control of the shrink stroke.

Here, the positioning members PM (which are secured to the peripheral margin 80 as illustrated in FIGS. 9 and 10A-10B) are distributed longitudinally and some of them are configured to limit shrink stroke of the longitudinal sides of the protecting body by a stopping effect due to engagement of the positioning members PM against the interior surfaces of the abutment rims.

All or parts of the positioning members PM are stoppers for providing strokes limitation between the stoppers 41, 41' 42 and the abutment surfaces BS1, BS2 included in the frame 15 of the holding and retaining assembly HR. Referring to FIG. 12, the stoppers 41, 41' arranged at or near a middle section MS of the pouch 2 are involved to create a belt effect. In some embodiments, such belt effect is separating two bellies or bulges B1, B2.

The positioning members may act as stoppers 41 or 41' only in the two intermediate parts 82 of the protecting body 12. As a result, since stroke is allowed in regions closer to the corner regions CR, here in the end parts 81, the pouch 2 covered by the containment protecting body 12, 112 or 212 cannot form a single belly or bulge in the middle thereof.

Moreover, the optional ribs R1, R2, R2', R3, R4 prevent the plate outer surface S, S' from forming fold lines or hollows that limit good filling of the biopharmaceutical composition Q in the corner region. Such ribs, possibly with regions or portions of lower height (for instance only at the diagonal lines DL1, DL2 as guiding and accordion-like effect is already obtained along the four sides of the rectangular shaped protecting body 12, 112), may help in expanding the protecting body 12, 112 from the inside without creating hollows or inappropriate fold lines detrimental to filling at the corner regions CR.

It is understood that at a given level of filling, the pouch corners and protecting body corners can continue to move inwardly during filling operation, while the intermediate parts 82 are blocked by the stoppers 41, 41'. At the corner regions CR, shrink strokes are longer than in the middle and will allow storing at least the same liquid capacity than without the belly/bulge retention.

Still referring to FIG. 12, the stoppers 41, 41',42 may be at predefined positions, in order to form positing members PM. Here, only the stoppers 41, 41' that are located away from the end sides 120*a*, 120*b* have a relatively closer distance to a median symmetry plane of the protecting body 12, as compared to distance for the stoppers 42. In such option shown in FIG. 12, such stoppers 41, 41',42 follow displacement (shrinking) of the peripheral margin 80.

During filling operation, as the stoppers 41, 41' provided in intermediate parts 82 of the longitudinal margin portions 8*a*, 8*b* are (initially) shifted inwardly due to arrangement of the attachment system 18, and because the abutment surfaces BS1, BS2 are in alignment, parallel to the X direction, these stopper 41, 41' are in abutment state against the abutment surfaces AB1, AB2 well before the stoppers 42 adjacent to/facing a corresponding corner region CR. A belly retention effect at the middle of the protecting body 12, 112 is obtained.

In options, ribs R1, R2, R2' R3, R4 are provided in the plates 12A, 12B. In such kind of option, the retention effect (decreasing bulge effect in the middle region MR, near the center C) is completed by a regular expansion of the regions around the panels PP or PP1, PP2, preventing undesirable formation of pronounced fold lines. Possibly, some corner ribs or rib portions C1, C2 have a decreasing height profile toward the intersection region with the diagonals DL1, DL2.

Of course, FIG. 12 is only an exemplary embodiment for managing the shrink of the plates 12A, 12B. More generally, the protecting body 12 can be mounted to sandwich the flexible pouch 2 and may be received/hold in an interspace of any suitable holding and retaining assembly HR, which is rigid and delimits an outer circumference of the system 1. Depending on level of filling of the pouch 2 sandwiched by the plates 12A, 12B, the protecting body 12 may comprise one or more areas of maximum thickness. In order to accommodate this thickness variation, the holding and retaining assembly HR may be of annular shape.

Figure 13A:
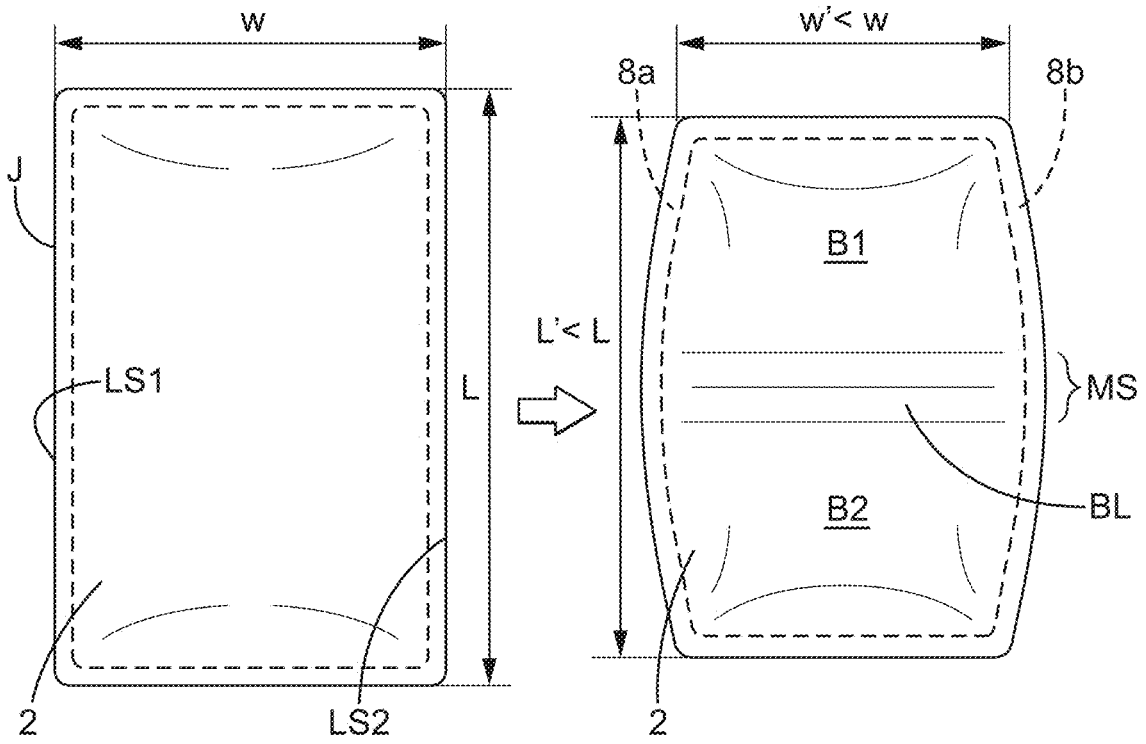
FIG. 13A is a top view of the flexible pouch filled with liquid inside a protecting device without illustrating the protecting body and the positioning members.
Figure 13B:
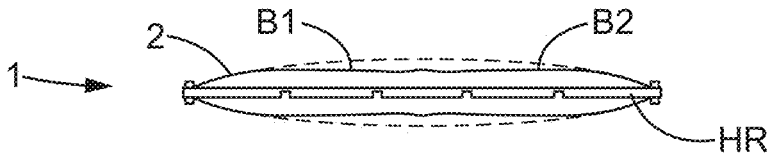
FIG. 13B is a side view showing a frame-like holder and the flexible pouch filled with liquid inside the system of FIG. 7 or 8 without illustrating the protecting body and the positioning members.

The one or more bulges/bellies B1, B2 as illustrated in FIGS. 13A-13B can be formed due to the expansion control and early stopping effect at the intermediate parts (thanks to the early blocking stopper 41 and/or 41' for instance), so that the middle section MS is much less moved as compared to complementary sections covered by parts of the protecting body 12 that are near the first and second end sides 120*a*, 120*b*.

More generally, any configuration with positioning members PM able to form stoppers away from the corner regions CR may be provided, so that a higher constraining effect can be obtained in a center of the pouch 2, as illustrated in FIGS. 9A-9B in particular. This is of interest for managing freeze/thaw operations of biopharmaceutical materials contained in the pouch 2. This is also of interest to better stacking the systems such as illustrated in FIGS. 6-9, with higher compactness (less vertical space between two adjacent storage units 10), thus offering opportunities to store more pouches 2 in a freezing chamber.

Dashed lines in FIG. 13B show the kind of belly usually obtained when similarly allowing a significant stroke in each region of the peripheral margin 80. It is thus of interest to limit or prevent the displacement of the middle part of the protecting body 12, 112, 212, in order to limit accumulated mass (of important thickness) that could be difficult to be thawed.

FIG. 13A shows that the frame 15 or any kind of holding part of the assembly HR is suitable to allow the protecting body 12, 112, 212 to change its conformation (with decrease in body width and in body length), thus allowing reducing:

the pouch 2 in width (with w'<w, where w' is the pouch width in filled state, as compared to pouch width w in empty state), and the pouch 2 in length (with L'<L, where L' is the pouch length in filled state, as compared to pouch length L in empty state).

In some variants, the positing members PM may be positioned in through slots and maintained stationary, for instance by being secured to or integral with the rigid frame 15 or similar holding and retaining assembly. The slots in the protecting body may be of greater size only near the end sides 120*a*, 120*b*, thus allowing greater shrinking only at the corner regions CR and preventing forming a too great bulge near the center C (due to belly effect/retention in the intermediate parts where the positioning members are early stopping members).

The holding and retaining assembly HR may comprise at least three positioning members PM distributed on each of the longitudinal sides 120*c*, 120*d*, with typically one or two central stoppers 41 corresponding to the positioning members PM arranged away from the corner regions CR.

Referring to FIGS. 7-8, the pouch expansion is limited and controlled by the protecting body 12, 112, due to lower flexibility of the material of the two plates 12A, 12B. The protecting body is made of a freeze resistant polyester or copolyester material that is not brittle at about 25° F. or −4° C. This material is for instance PET or a robust copolyester of TRITAN™ type.

The flexible pouches 2 can be frozen, thawed, filled or emptied simultaneously when they are stored on stacked protecting bodies 12, 112, using the frames 15. When the flexible pouches 2 are stored, the biopharmaceutical fluid can be frozen or thawed. When the flexible pouches 2 are shipped, most often, the biopharmaceutical fluid is thawed even if the biopharmaceutical fluid can as well be frozen.

Now referring to FIG. 4, it can be seen that the two plates 12A, 12B may also comprise through holes 25, for instance regularly arranged on the peripheral sides of the two plates. The through-holes 25 coincide, in the assembled state of the protecting body 12, and extend in the margin portions 8*a*, 8*b*, in order to form protecting body through-slots that do not interfere with the covering part covering the pouch 2. More generally, protecting body through-slots, any kind of reliefs, or suitable positioning members PM are provided in one or more of the margin portions 8*a*, 8*b*, in order to cooperate with complementary elements adapted to restrict expansion by preventing or limiting inward displacement of the longitudinal sides 120*c*, 120*d* of the protecting body in assembled state. Such complementary elements form positioning members PM because they are involved in determining the final position of longitudinal side sections at the end of the filling of the flexible pouch 2, typically by abutting against an outer edge included in a margin portion 8*a* or 8*b*.

As illustrated in FIG. 4, the flexible pouch 2 typically comprises, here along one of the transversal sides, a through-hole 2*c* which can form a handle for the flexible pouch 2. This is of interest when the pouch capacity is sufficiently low to permit manual carriage of the pouch 2.

The plates 12A, 12B here have same thickness e, as illustrated in FIG. 4, which is a constant thickness in the plate contact part for contact with the pouch (which here forms the covering part 8). Such thickness e may be also present in the margin portions 8*a*, 8*b* in the regions provided with the through-slots. In some variants, the margin portions 8*a*, 8*b*, may be reinforced by at least one additional stiffening layer.

Length of the two opposite margin portions 8*a*, 8*b* is here substantially the same. Such length may be for example superior to 250 or preferably superior to 350 mm, which of interest to provide at least three through-slots regularly distributed in at least one margin portion, preferably in all of these margin portions 8*a*, 8*b*, while having excellent robustness. This length may correspond to more than 75% of the total length of the pouch 2, before filling the pouch 2.

The freeze/thaw system 1 may be optionally provided with clamps, here two clamps 11, 13 in the example of FIG. 4. Each clamp 11, 13 is located near to a corner between the front edge 2*a* of the flexible pouch 2 and a long side or similar longitudinal edge. Each clamp 11, 13 respectively pinches one hose or tube Tat a straight angle. Thus, each plate 12A, 12B may comprise a cut-out located at each corner between its front I edge and adjacent edge parallel to the longitudinal axis A. These cut-outs create a free space that can be occupied by the clamps 11, 13.

With such arrangement, the frame or similar holding assembly HR may possibly only support the two margin portions 8*a*, 8*b*. The frame structure may be particularly simple when the capacity of the pouch 2 is lower than 10 or 20 liters.

Independently of the way the positioning members PM are provided in the peripheral margin 80, the protecting body 12, 112, 212 mounted to sandwich the flexible pouch 2 may be received in a single cavity of interior space of any suitable holding and retaining device HR, which is rigid and delimits an outer circumference of the system 1. Depending on level of filling of the pouch 2 sandwiched by the plates 12A, 12B, the protecting body 12 may comprise one or more areas with ribbing.

In order to accommodate the corresponding thickness variation (as measured on corresponding outer surface S or S', from the protecting body reference plane along Z axis-direction), the holding and retaining device may be of annular shape without covering the covering part 8. The one or more bulges/bellies B, B1, B2 can be formed due to the expansion control and early stopping effect at the intermediate parts 82, so that the middle section MS illustrated in FIG. 13A is much less movable as compared to complementary sections of the protecting body 12. At the middle section MS, the total thickness (or maximum in thickness) is less than 300 mm, for example around 230 or 260 mm, while total length of the protecting body is typically superior to 1400 mm. In other words, the ratio thickness:length may be kept inferior to 1:4, which is of interest for stacking efficiency and compactness.

The system 1 is well adapted for freezing, storing and thawing biopharmaceutical materials contained in a flexible pouch 2 of simple conception. A protecting device 10 as above described is of interest for filing the pouch 2 with a controlled and restricted expansion, so that expansion is restricted in one or more areas where the fluid thickness would reach a maximum if no expansion control is carried. The interior volume or cavity delimited by the main walls W1, W2 is expanded with prevention of free expansion in the middle areas of these walls W1, W2. Especially expansion can be limited along one or more belt line BL that joins the two intermediate parts 82, as illustrated in FIG. 13A.

Depression along such belt line BL, due to the low or inexistent shrink stroke in the intermediate parts 82, typically creates at least one recess. In the pouch 2 as filled and in containment configuration of the storage unit 10, at least one recess is thus created in the filled pouch 2 between the two bulges B1, B2 that are formed respectively in front of and at rear of the belt line BL (line crossing the at least one recess). Of course, such effect does not prevent fluid communication between the two opposite regions where a bulge B1 or B2 is formed. This allows a generally equal distribution of fluid. As more than one region is created with bulge formation, a more uniform thickness distribution is obtained, without decreasing the capacity of the pouch 2. In other words, the decreased thickness of each region decreases the thickness at any one point in the pouch 2, and thus no "belly" is formed.

The ribbing also facilitates having the belt effect without undesirable waves or folds which impair filling in the corner region CR.

The pouch 2 and the storage unit 10 may be exposed to a temperature of about −70° C. or lower to freeze the biopharmaceutical fluid. The annular shape of the shell HR is of interest to provide a recessed area where cold air can circulate and flow between systems 1 (even if they are staked). But other shapes and structures may be used to form a holding and retaining device for a controlled expansion, in order to eliminate or reduce the formation of too significant projections during freezing. In some options with a shell covering/contacting the covering part 8, this also facilitates separation of the halves or protecting parts 3, 4 of the shell HR.

The present invention has been described in connection with the preferred embodiments. These embodiments, however, are merely for example and the invention is not restricted thereto.

Of course, the pouches 2 of the present invention are not in any way limited to pouches having four sides and/or pouches that are larger than wide. The pouches 2 may have other shapes provided with two generally parallel sides, covered by the pair of plates 12A, 12B or similar protecting body including two flat portions.

In preferred embodiments as illustrated, the positioning members PM are sliding members inserted in slots or holes of the peripheral margin 80 or through-slots 25. In variants, the protecting body through-slots may be replaced by at least one cavity or hollow included in the respective plates, for receiving a positioning member PM that prevent inward movement, locally in a margin portion 8*a* or 8*b*.

Variation of the clearance for the shrink stroke may be obtained by abutting members included in a shell or covering parts that are differently positioned relative to the through-holes 25, as in FIG. 4, of with abutting members or positioning members PM made separate from the device HR, mounted on a frame 15 and having a stroke limited by appropriate surfaces BS1, BS2.

It will be understood by those skilled in the art that other variations and modifications can easily be made within the scope of the invention as defined by the appended claims, thus it is only intended that the present invention be limited by the following claims.

Any reference sign in the following claims should not be construed as limiting the claim. It will be obvious that the use of the verb "to comprise" and its conjugations does not exclude the presence of any other elements besides those defined in any claim. The word "a" or "an" preceding an element does not exclude the presence of a plurality of such elements.

The invention claimed is:

1. A protecting device for use in freezing, storing, and thawing biopharmaceutical materials contained in a flexible pouch, the protecting device comprising:

a protecting body comprising two plates for protecting the flexible pouch, the protecting body comprising a longitudinal axis and having four sides, the four sides comprising two longitudinal sides extending parallel to the longitudinal axis and two other sides that include a first end side and a second end side each perpendicular to the longitudinal axis; and an attachment system for fastening the two plates so that in an assembled state of the two plates, the protecting body comprises a peripheral margin that extends annularly in a protecting body reference plane, the peripheral margin being provided with at least one opening able to receive at least one port of the flexible pouch, wherein the two plates define two mutually unfixed facing parts forming a covering part for covering the flexible pouch, the covering part being surrounded by the peripheral margin, wherein in the assembled state:

the two plates are configured to sandwich the flexible pouch for constraining the flexible pouch in a filled state of the flexible pouch, the protecting body being deformable due to shrinking of the two plates in at least one direction belonging to the protecting body reference plane, the two plates respectively form a first outer surface and a second outer surface of the protecting body, facing in opposite directions, at least one amongst the first outer surface and the second outer surface being wavy due to a plurality of ribs, which are deformable and extend at least on a peripheral annular region of the covering part, along the peripheral margin, in order to locally structure the covering part of the protecting body, and the protecting body extends planar in an empty state of the flexible pouch, along the protecting body reference plane, the protecting body being expandable from a planar state.

2. The protecting device according to claim 1, wherein the plurality of ribs are distributed at least in two opposite parts of the surface which are longitudinally opposite parts.

3. The protecting device according to claim 2, wherein the plurality of ribs includes one or more first transverse rib portions proximal or adjacent to the first end side and one or more second transverse rib portions proximal or adjacent to the second end side.

4. The protecting device according to claim 3, wherein the plurality of ribs further includes a group of elongated rib portions, extending in the peripheral annular region of the covering part, perpendicular to any one of the first transverse rib portions and the second transverse rib portions, and wherein the covering part of each of the two plates is movable as a function of said shrinking of the two plates, in order to locally deviate from the protecting body reference plane, in a region adjacent to the peripheral margin, with a variation of at least 25° when the protection body is expanded, as compared to the planar state.

5. The protecting device according to claim 4, wherein the group of elongated rib portions comprise two opposite elongated rib portions, which are longer than any one of the first transverse rib portions and the second transverse rib portions.

6. The protecting device according to claim 4, further comprising:

corner ribs that are curved, the corner ribs comprising first corner ribs interconnecting one of elongated rib portions with one of the first transverse rib portions.

7. The protecting device according to claim 6, wherein the corner ribs further comprise second corner ribs interconnecting one of elongated rib portions with one of the second transverse rib portions.

8. The protecting device according to claim 4, wherein in said surface, a continuous rectangular region without any ribs is surrounded by:

a first group of ribs extending annularly in the peripheral annular region of the covering part; and a second group of ribs extending parallel to the first group of ribs and arranged closer to the peripheral margin as compared to the first group.

9. The protecting device according to claim 2, wherein the first outer surface, which is delimited by the peripheral margin, is a lower surface of the protecting body, while the second outer surface, delimited by the peripheral margin, is an upper surface of the protecting body.

10. The protecting device according to claim 2, wherein the protecting body is provided with ribs in the first outer surface and in the second outer surface, so that a first plurality of ribs is formed on the first outer surface and a second plurality of ribs is formed on the second outer surface, and wherein the protecting body is configured to expand along a direction perpendicular to the body reference plane due to filling of the flexible pouch sandwiched between the two plates, so that the two mutually unfixed facing parts form respective panels, which are each:

extending parallel to the protecting body reference plane, and surrounded by reliefs elongated to extend parallel to the peripheral margin, the reliefs protruding outwardly and being formed by a part of the ribs included in the protecting body.

11. The protecting device according to claim 3, wherein the protecting body is provided with ribs in the first outer surface and in the second outer surface, so that a first plurality of ribs is formed on the first outer surface and a second plurality of ribs is formed on the second outer surface, and wherein each of the two plates comprises at least one plate panel part extending between the first transverse rib portions and the second transverse rib portions.

12. The protecting device according to claim 1, wherein the peripheral margin is configured to remain planar, due to the attachment system, the ribs including a group of ribs arranged away from the peripheral margin.

13. The protecting device according to claim 1, wherein the plurality of ribs, deformable, includes one or more first transverse rib portions proximal or adjacent to the first end side and one or more second transverse rib portions proximal or adjacent to the second end side, which form two groups of accordion-like ribs, so that a wavy profile due to the deformable ribs is distributed at opposite regions of the protecting body, respectively near the first end side and near the second end side.

14. The protecting device according to claim 3, wherein each of the first transverse rib portions and the second transverse rib portions extends perpendicular to the longitudinal axis and belong to an intermediate region between two corner regions respectively adjacent to an intersection of two of the four sides, and wherein the two corner regions are formed to be elastically more deformable than the intermediate region provided with the first transverse rib portions and the intermediate region provided with the second transverse rib portions.

15. The protecting device according to claim 13, wherein each intermediate region is adjacent to one amongst the first end side and the second end side, wherein each amongst the first outer surface and the second outer surface comprises longitudinal rib portions that extend parallel to the longitudinal axis in two opposite side regions, in order to be each proximal to the peripheral margin and distal to the longitudinal axis, and wherein each of the corner regions are formed to be elastically more deformable than any one of the side regions provided with the longitudinal rib portions.

16. The protecting device according to claim 1, wherein the two plates are two separate pieces having same circumferential size and same outer shape, each of the first outer surface and the second outer surface comprising first transverse rib portions proximal to the first end side and second transverse rib portions proximal to the second end side.

17. The protecting device according to claim 1, wherein the plurality of ribs and the protecting body are made of same freeze resistant polyester or copolyester material, the two plates being two separate pieces.

18. The protecting device according to claim 1, wherein each rib of the plurality of ribs delimits an interior hollow opening inwardly, in order to open toward the flexible pouch, and is separate from the peripheral margin so that the interior hollow provides additional volume in an interspace between the two plates, and wherein each of the two plates is formed to be elastically deformable, in order to deform from an initial planar plate shape, in which the peripheral margin and the covering part are coplanar.

19. A protecting device for use in freezing, storing and thawing biopharmaceutical materials contained in a flexible pouch, the protecting device comprising:

a protecting body comprising two plates for protecting the flexible pouch, the protecting body comprising a longitudinal axis and having four sides, the four sides comprising two longitudinal sides extending parallel to the longitudinal axis and two other sides that include a first end side and a second end side each perpendicular to the longitudinal axis;

an attachment system for fastening the two plates so that in an assembled state of the two plates, the protecting body comprises a peripheral margin that extends annularly in a protecting body reference plane, the peripheral margin being provided with at least one opening able to receive at least one port of the flexible pouch, the two plates having a same thickness that is lower than 2 mm so that the protecting body is a thin body, are formed to be elastically more deformable, define two mutually unfixed facing parts forming a covering part for covering the flexible pouch, the covering part being surrounded by the peripheral margin, each of the two plates having a density superior to 1.10 g/cm$^3$ and being made of plastic material, wherein in the assembled state:

the two plates are configured to sandwich the flexible pouch for constraining the flexible pouch in a filled state of the flexible pouch, the protecting body being deformable due to shrinking of the two plates in at least one direction belonging to the protecting body reference plane, the two plates respectively form a first outer surface and a second outer surface of the protecting body, facing in opposite directions, at least one amongst the first outer surface and the second outer surface being a surface having a plurality of ribs, which extend at least on a peripheral annular region of the covering part, along the peripheral margin, in order to locally structure the covering part of the protecting body, and the protecting body extends planar in an empty state of the flexible pouch, along the protecting body reference plane, so that a protecting body constraining effect applies in relation with the pouch until the flexible pouch is emptied.

20. The protecting device according to claim 1, wherein each of two plates is a plate having a rectangular shape with four corners and two virtual diagonal lines each intersecting a pair of corner vertices of the four corners, and wherein each of the two virtual diagonal lines intersects:

a first series of corner ribs proximal to the first end side and protruding outwardly along a direction perpendicular to the protecting body reference plane, and a second series of corner ribs proximal to the second end side and protruding outwardly along a direction perpendicular to the protecting body reference plane, each of the corner ribs being curved and connecting two rib portions that are perpendicular one to each other.

21. A freeze/thaw containment system for containing a biopharmaceutical composition, comprising: the protecting device according to claim 1, and a flexible pouch sandwiched between the two plates, the flexible pouch being fillable with a biopharmaceutical composition via at least one port of the flexible pouch which protrudes outwardly through the least one opening, the flexible pouch being more flexible than material of the protecting body.

* * * * *